US008619017B2

(12) United States Patent
Kimura et al.

(10) Patent No.: US 8,619,017 B2
(45) Date of Patent: Dec. 31, 2013

(54) DISPLAY DEVICE AND DISPLAY CONTROL METHOD

(75) Inventors: Kazuto Kimura, Kanagawa (JP); Kaoru Yanamoto, Kanagawa (JP); Hiroaki Yasunaga, Tokyo (JP); Yasushi Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 1290 days.

(21) Appl. No.: 11/807,407

(22) Filed: May 29, 2007

(65) Prior Publication Data

US 2007/0296689 A1 Dec. 27, 2007

(30) Foreign Application Priority Data

Jun. 2, 2006 (JP) ..... 2006-154763

(51) Int. Cl.
*G09G 3/36* (2006.01)

(52) U.S. Cl.
USPC ..... 345/102; 345/89

(58) Field of Classification Search
USPC ..... 345/87, 102, 103
See application file for complete search history.

(56) References Cited

U.S. PATENT DOCUMENTS

2006/0221260 A1* 10/2006 Fujine et al. ..... 348/790
2007/0216311 A1* 9/2007 Cernasov et al. ..... 315/3

FOREIGN PATENT DOCUMENTS

JP 2002-099250 A 4/2002
JP 2003-177727 A 6/2003
JP 2004-110050 A 4/2004
JP 2004-163518 A 6/2004
JP 2004-212503 7/2004
JP 2004-246117 9/2004
JP 2005-159595 A 6/2005

* cited by examiner

*Primary Examiner* — Charles V Hicks

(74) *Attorney, Agent, or Firm* — Wolf, Greenfield & Sacks, P.C.

(57) ABSTRACT

A display device to display an image corresponding to image signals in a display area is provided. The display device includes a backlight including individually placed light sources corresponding to areas in the display area; a panel that includes pixels corresponding to the display area and that changes transmittance of light from the light sources in units of pixels; a panel control unit to individually set emission brightness of each of the light sources in accordance with the image signals and set the transmittance of light in each of the pixels in accordance with the emission brightness; a storage unit to store a nonlinear conversion table to convert the emission brightness to a light source control value for the backlight; and a backlight control unit to convert the emission brightness to the light source control value in accordance with the nonlinear conversion table and supply the light source control value to the backlight.

15 Claims, 16 Drawing Sheets

DISPLAY DEVICE AND DISPLAY CONTROL METHOD

CROSS REFERENCES TO RELATED APPLICATIONS

The present invention contains subject matter related to Japanese Patent Application JP 2006-154763 filed in the Japanese Patent Office on Jun. 2, 2006, the entire contents of which are incorporated herein by reference.

BACKGROUND OF THE INVENTION

1. Field of the Invention

The present invention relates to a display device and a display control method, particularly to a display device and a display control method for reducing flicker of images.

2. Description of the Related Art

A liquid crystal display (LCD) device includes a liquid crystal panel having a color filter substrate colored with R (red), G (green), and B (blue) and a liquid crystal layer; and a backlight placed on the back side thereof.

In the LCD device, twist of liquid crystal molecules in the liquid crystal layer is controlled by changing a voltage. Light beams from the backlight passed through the liquid crystal layer in accordance with the twist of the liquid crystal molecules pass through the color filter substrate, colored with R, G, and B, so that each of the light beams becomes an R, G, or B light beam. Accordingly, In the following description, changing the transmittance of light by controlling twist of liquid crystal molecules by changing a voltage is referred to as "control of an aperture ratio". The brightness of light emitted from the backlight serving as a light source is called "emission brightness", whereas the brightness of light emitted from the front surface of the liquid crystal panel, that is, the intensity of light recognized by a user seeing a displayed image, is called "display brightness".

In a conventional LCD device, the backlight evenly lights the entire screen of the liquid crystal panel with (substantially) maximum intensity, and only the aperture ratio of each pixel in the liquid crystal panel is controlled so that a required display brightness can be obtained in each pixel of the screen. In this case, the backlight emits light with maximum emission brightness even if the entire screen is dark, which causes a problem of high power consumption.

As countermeasures against this problem, there is suggested a method of dividing a screen into a plurality of areas and controlling the emission brightness of the backlight in units of the areas (e.g., see Patent Documents 1 and 2: Japanese Unexamined Patent Application Publication Nos. 2004-212503 and 2004-246117).

The control of backlight according to these known arts is described with reference to FIGS. 1A to 1C.

FIG. 1A shows an original image P1 displayed in an LCD device. The original image P1 has an oval darkest area R1 at the center thereof. The image is lighter toward the outer side of the area R1.

FIG. 1B shows a simplified configuration of the backlight.

In the backlight shown in FIG. 1B, the light emission area has 24 areas, that is, 4 areas in the horizontal direction×6 areas in the vertical direction.

When the backlight shown in FIG. 1B emits light corresponding to the original image P1, the backlight suppresses the emission brightness of the two shaded areas in FIG. 1B (darkened).

As a result, in the entire backlight, the distribution of emission brightness shown in FIG. 1C can be obtained for the original image P1 shown in FIG. 1A, and the part of the backlight corresponding to the darkest area R1 is darkened. Accordingly, the power consumption is reduced.

SUMMARY OF THE INVENTION

However, there may be a case shown in FIG. 2, that is, a bright area R2 exists in a darkest area R1 in an original image P2. In this case, the emission brightness of the backlight and the aperture ratio of each pixel are controlled so that sufficient display brightness can be obtained in the area R2.

The original images P1 and P2 have the same display brightness in the area R1. In order to display the area R2 of high brightness, the emission brightness of the backlight is set to higher when the original image P2 is displayed than when the original image P1 is displayed. On the other hand, the aperture ratio of the pixels in the area R1 around the area R2 is set to lower when the original image P2 is displayed than when the original image P1 is displayed.

In the LCD device, the emission brightness of the backlight and the aperture ratio of the pixels are controlled in units of images. If the relationship between the emission brightness of the backlight and the aperture ratio of the pixels is not properly set or includes an error, an area that should have the same display brightness in a plurality of images is displayed with varied display brightness. This may be recognized by a user as flicker of the images.

The present invention has been made in view of these circumstances, and is directed to reducing flicker of images.

According to an embodiment of the present invention, there is provided a display device to display an image corresponding to image signals in a predetermined display area. The display device includes a backlight including a plurality of individually placed light sources corresponding to a plurality of areas included in the display area; a panel that includes a plurality of pixels corresponding to the display area and that changes transmittance of light from the light sources in units of pixels; panel control means for individually setting emission brightness of each of the light sources in accordance with the image signals and setting the transmittance of light in each of the pixels in accordance with the emission brightness of each of the light sources set individually; storage means for storing a nonlinear conversion table to convert the emission brightness of each of the light sources to a light source control value for the backlight; and backlight control means for converting the emission brightness of each of the light sources set by the panel control means to the light source control value in accordance with the nonlinear conversion table and supplying the light source control value to the backlight.

The nonlinear conversion table may be a table in which the amount of change in the light source control value caused by an increase in the emission brightness by a predetermined unit becomes large as the emission brightness becomes higher.

The nonlinear conversion table may be a table in which the rate of change in the light source control value caused by an increase in the emission brightness by a predetermined unit is a predetermined rate or lower.

The panel control means may further set a minimum value of the emission brightness of each of the light sources.

According to an embodiment of the present invention, there is provided a display control method for a display device that includes a backlight including a plurality of individually placed light sources corresponding to a plurality of areas included in a predetermined display area and a panel that includes a plurality of pixels corresponding to the display area and that changes transmittance of light from the light sources in units of pixels and that displays an image corresponding to image signals in the display area. The display control method includes the steps of: individually setting emission brightness of each of the light sources in accordance with the image signals and setting the transmittance of light in each of the pixels in accordance with the emission brightness of each of the light sources set individually; and converting the emission brightness of each of the light sources to a light source control value in accordance with a nonlinear conversion table to convert the emission brightness of each of the light sources to the light source control value for the backlight and supplying the light source control value to the backlight.

When the emission brightness of each of the light sources is individually set in accordance with the image signals, the emission brightness may be set so as to be within one level of gray scale of the emission brightness that is set at the previous time.

According to an embodiment of the present invention, emission brightness of each of a plurality of light sources is individually set in accordance with image signals. Also, transmittance of light in each of pixels is set in accordance with the individually set emission brightness. Furthermore, the emission brightness is converted to a light source control value in accordance with a nonlinear conversion table to convert the emission brightness to the light source control value for the backlight, and the light source control value is supplied to the backlight.

According to an embodiment of the present invention, images can be displayed. According to another embodiment of the present invention, flicker of images can be reduced.

DESCRIPTION OF THE PREFERRED EMBODIMENTS

Figure 1A:
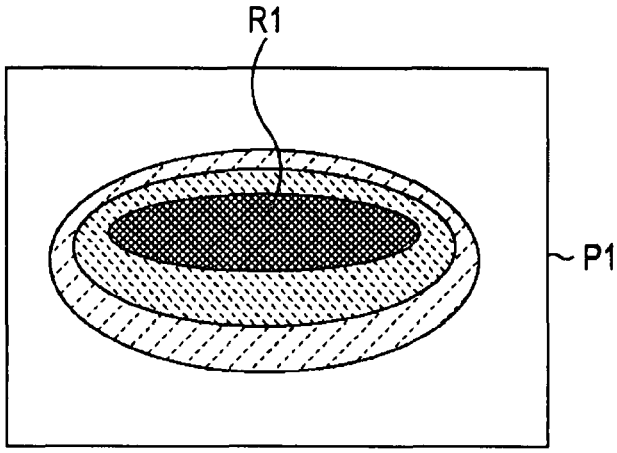
FIGS. 1A to 1C illustrate conventional control of a backlight.
Figure 1B:
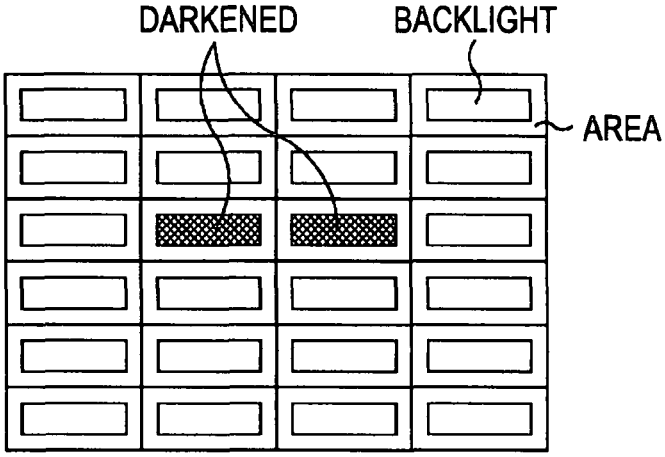
Figure 1C:
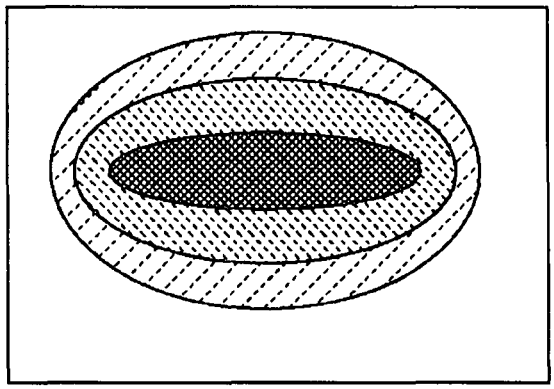
Figure 2:
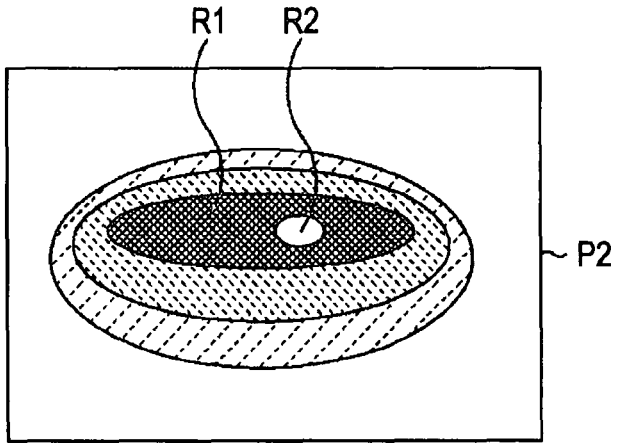
FIG. 2 illustrates the conventional control of the backlight.

Before describing embodiments of the present invention, the correspondence between the features of the claims and the specific elements in the embodiments described in the specification or drawings is discussed below. This description is intended to assure that the embodiments supporting the present invention are described in the specification or drawings. Thus, even if an element in the following embodiments is not described as relating to a certain feature of the present invention, that does not necessarily mean that the element does not relate to that feature of the claims. Conversely, even if an element is described herein as relating to a certain feature of the claims, that does not necessarily mean that the element does not relate to other features of the claims.

A display device according to an embodiment of the present invention is a display device (e.g., a liquid crystal display device 101 shown in FIG. 17) to display an image corresponding to image signals in a predetermined display area. The display device includes a backlight (e.g., a backlight 12 shown in FIG. 17) including a plurality of individually placed light sources corresponding to a plurality of areas included in the display area; a panel (e.g., a liquid crystal panel 11 shown in FIG. 17) that includes a plurality of pixels corresponding to the display area and that changes transmittance of light from the light sources in units of pixels; panel control means (e.g., a liquid crystal panel control circuit 131 shown in FIG. 17) for individually setting emission brightness of each of the light sources in accordance with the image signals and setting the transmittance of light in each of the pixels in accordance with the emission brightness of each of the light sources set individually; storage means (e.g., a memory 132 shown in FIG. 17) for storing a nonlinear conversion table to convert the emission brightness of each of the light sources to a light source control value for the backlight; and backlight control means (e.g., a light source control circuit 33 shown in FIG. 17) for converting the emission brightness of each of the light sources set by the panel control means to the light source control value in accordance with the nonlinear conversion table and supplying the light source control value to the backlight.

A display control method according to an embodiment of the present invention is a display control method for a display device that includes a backlight including a plurality of individually placed light sources corresponding to a plurality of areas included in a predetermined display area and a panel that includes a plurality of pixels corresponding to the display area and that changes transmittance of light from the light sources in units of pixels and that displays an image corresponding to image signals in the display area. The display control method includes the steps of: individually setting emission brightness of each of the light sources in accordance with the image signals (e.g., step S24 shown in FIG. 21) and setting the transmittance of light in each of the pixels in accordance with the emission brightness of each of the light sources set individually (e.g., step S25 shown in FIG. 21); and converting the emission brightness of each of the light sources to a light source control value in accordance with a nonlinear conversion table to convert the emission brightness of each of the light sources to the light source control value for the backlight and supplying the light source control value to the backlight (e.g., step S27 shown in FIG. 21).

Hereinafter, embodiments of the present invention are described with reference to the drawings.

First, a liquid crystal display (LCD) device 1 serving as basis of the present invention is described with reference to FIG. 3.

Figure 3:
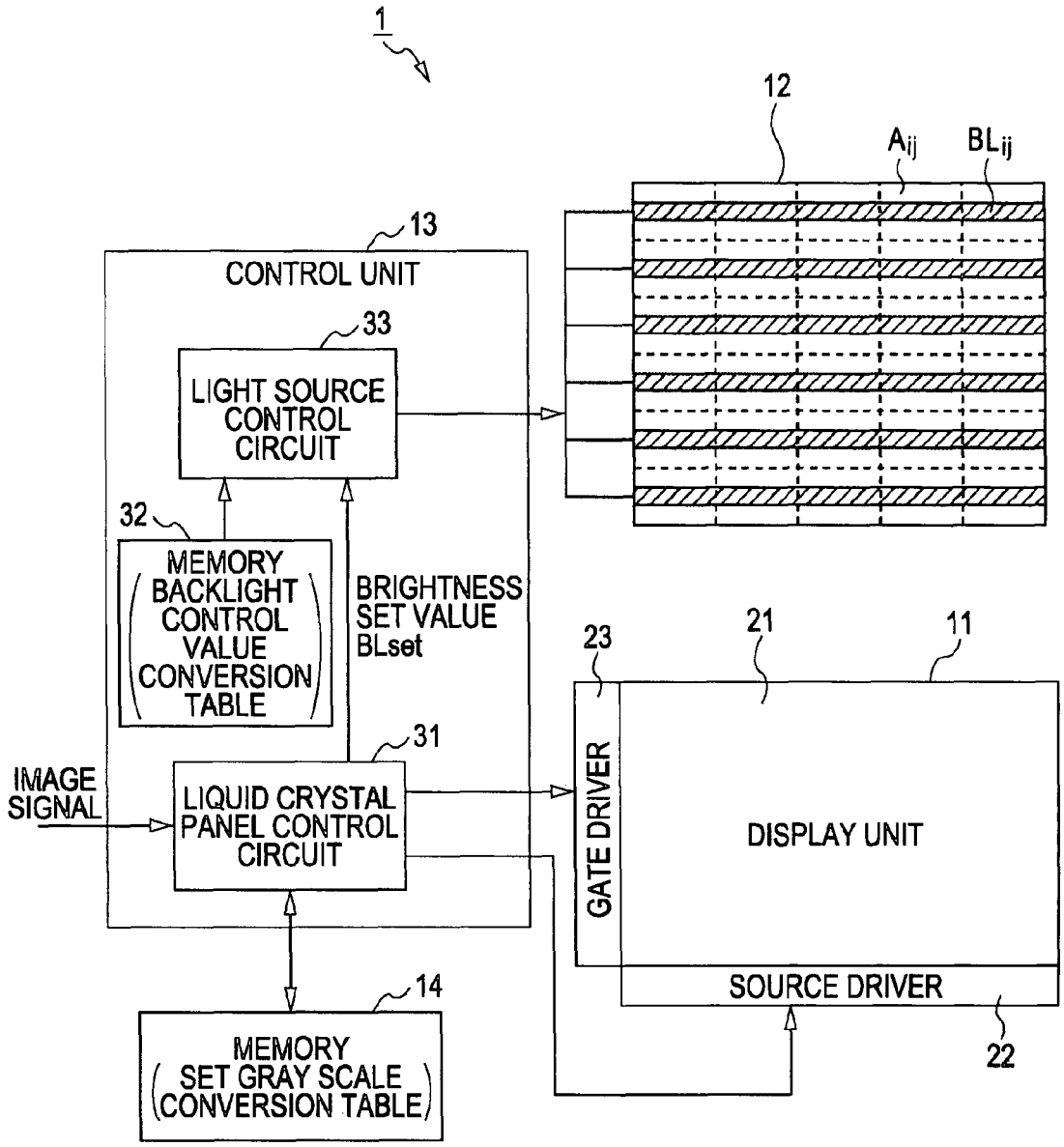
FIG. 3 shows an example of a configuration of a liquid crystal display (LCD) device serving as basis of the present invention.

The LCD device 1 shown in FIG. 3 includes a liquid crystal panel 11 having a color filter substrate colored with R, G, and B and a liquid crystal layer; a backlight 12 placed on the back side of the liquid crystal panel 11, a control unit 13 to control the liquid crystal panel 11 and the backlight 12, and a memory 14. The LCD device 1 displays an original image corresponding to input image signals in a predetermined display area (display unit 21). The image signals input to the LCD device 1 correspond to an image having a frame rate of 60 Hz (hereinafter referred to as a field image).

The liquid crystal panel 11 includes the display unit 21 in which a plurality of apertures as pixels allowing light from the backlight 12 to pass therethrough are arranged; and a source driver 22 and a gate driver 23 to transmit drive signals to transistors (TFTs: thin film transistors, not shown) that are provided for the respective pixels in the display unit 21 in a one-to-one relationship.

The backlight 12 emits white light in a predetermined lighting area corresponding to the display unit 21. The lighting area of the backlight 12 has a plurality of areas, and lighting is individually controlled for the respective areas.

In FIG. 3, the lighting area of the backlight 12 has 30 areas $A_{11}$ to $A_{56}$, that is, 5 areas in the horizontal direction×6 areas in the vertical direction. The backlight 12 includes light sources $BL_{11}$ to $BL_{56}$ corresponding to the areas $A_{11}$ to $A_{56}$.

The light source $BL_{ij}$ (i=1 to 5 and j=1 to 6) placed in the area $A_{ij}$ includes a red light emitting diode (LED), a green LED, and a blue LED arranged in a predetermined order. The light source $BL_{ij}$ emits white light as a mixture of red light, green light, and blue light, with the brightness corresponding to a backlight control value $BLctl_{ij}$ supplied from a light source control circuit 33.

The areas $A_{11}$ to $A_{56}$ are generated not by physically dividing the lighting area of the backlight 12 by using partitions or the like, but by virtually dividing the lighting area so that the areas $A_{11}$ to $A_{56}$ correspond to the light sources $BL_{11}$ to $BL_{56}$. Thus, the light emitted from the light source $BL_{ij}$ is diffused by a scattering plate or a scattering sheet (not shown) and is applied to not only the area $A_{ij}$ corresponding to the light source $BL_{ij}$ but also the area around the area $A_{ij}$.

The control unit 13 includes a liquid crystal panel control circuit 31 to control the liquid crystal panel 11, a memory 32, and the light source control circuit 33 to control the backlight 12.

The liquid crystal panel control circuit 31 is supplied with image signals corresponding to a field image from another device. The liquid crystal panel control circuit 31 obtains brightness distribution of the field image on the basis of the supplied image signals. Then, the liquid crystal panel control circuit 31 calculates a display brightness $Areq_{ij}$ required in the area $A_{ij}$ on the basis of the brightness distribution of the field image.

As described above, the light emitted from the light source $BL_{ij}$ is applied to not only the area $A_{ij}$ corresponding to the light source $BL_{ij}$ but also the area around the area $A_{ij}$. In other words, the display brightness $Areq_{ij}$ required in the area $A_{ij}$ can be obtained by combining the light emitted from the light source $BL_{ij}$ placed on the back side of the area $A_{ij}$ and the light emitted from the light sources around the light source $BL_{ij}$.

The liquid crystal panel control circuit 31 solves simultaneous equations (simultaneous inequalities) written for the respective areas $A_{11}$ to $A_{56}$, each of the equations defining that the display brightness $Areq_{ij}$ in the area $A_{ij}$ can be obtained by collecting the contribution of the emission brightness of the light source $BL_{ij}$ to the area $A_{ij}$ from the light sources $BL_{11}$ to $BL_{56}$. Accordingly, the liquid crystal panel control circuit 31 calculates brightness set values $BLset_{11}$ to $BLset_{56}$ to set the emission brightness of the light sources $BL_{11}$ to $BL_{56}$ and supplies the brightness set values $BLset_{11}$ to $BLset_{56}$ to the light source control circuit 33.

The equation defining that the display brightness $Areq_{ij}$ in the area $A_{ij}$ can be obtained by collecting the contribution of the emission brightness of the light source $BL_{ij}$ to the area $A_{ij}$ from the light sources $BL_{11}$ to $BL_{56}$ can be expressed by an expression defining that the sum of products of the brightness set values $BLset_{11}$ to $BLset_{56}$ of the light sources $BL_{11}$ to $BL_{56}$ and the contribution ratio of the light sources $BL_{11}$ to $BL_{56}$ to the area $A_{ij}$ is equal to or larger than the display brightness $Areq_{ij}$. Herein, the contribution ratio of each of the light sources $BL_{11}$ to $BL_{56}$ to the area $A_{ij}$ represents the percentage of light emitted from each of the light sources $BL_{11}$ to $BL_{56}$ included in the light emitted from the area $A_{ij}$, and is stored in the memory 14 in advance.

After determining the brightness set values $BLset_{11}$ to $BLset_{56}$, the liquid crystal panel control circuit 31 calculates set gray scale S_data' of each pixel in the display unit 21 on the basis of the brightness set values $BLset_{11}$ to $BLset_{56}$ by using a set gray scale conversion table stored in the memory 14. The set gray scale S_data' is an 8-bit value determining the aperture ratio of the pixel. Then, the liquid crystal panel control circuit 31 supplies the calculated set gray scale S_data' as drive control signals to the source driver 22 and the gate driver 23 of the liquid crystal panel 11.

The memory 32 stores a backlight control value conversion table, which is used to convert a brightness set value BLset of 8 bits and 256-level gray scale output from the liquid crystal panel control circuit 31 to a backlight control value BLctl of 10 bits and 1024-level gray scale as a control signal that is acceptable by the backlight 12.

The light source control circuit 33 converts the respective brightness set values $BLset_{11}$ to $BLset_{56}$ supplied from the liquid crystal panel control circuit 31 to backlight control values (light source control values) $BLctl_{11}$ to $BLctl_{56}$ on the basis of the backlight control value conversion table stored in the memory 32, and supplies the backlight control values $BLctl_{11}$ to $BLctl_{56}$ to the backlight 12. Accordingly, the light source $BL_{ij}$ placed in the area $A_{ij}$ of the backlight 12 emits light with emission brightness according to the backlight control value $BLctl_{ij}$. The backlight control value $BLctl_{ij}$ is a current value or a PWM (pulse width modulation) value, for example.

As described above, the memory 14 stores the contribution ratio of each of the light sources $BL_{11}$ to $BL_{56}$ to each of the areas $A_{11}$ to $A_{56}$, the contribution ratio is obtained in advance by experiment or the like. Also, the memory 14 stores the set gray scale conversion table to convert the brightness set values $BLset_{11}$ to $BLset_{56}$ to set gray scale S_data'. The set gray scale conversion table is described below with reference to FIG. 5.

Figure 4:
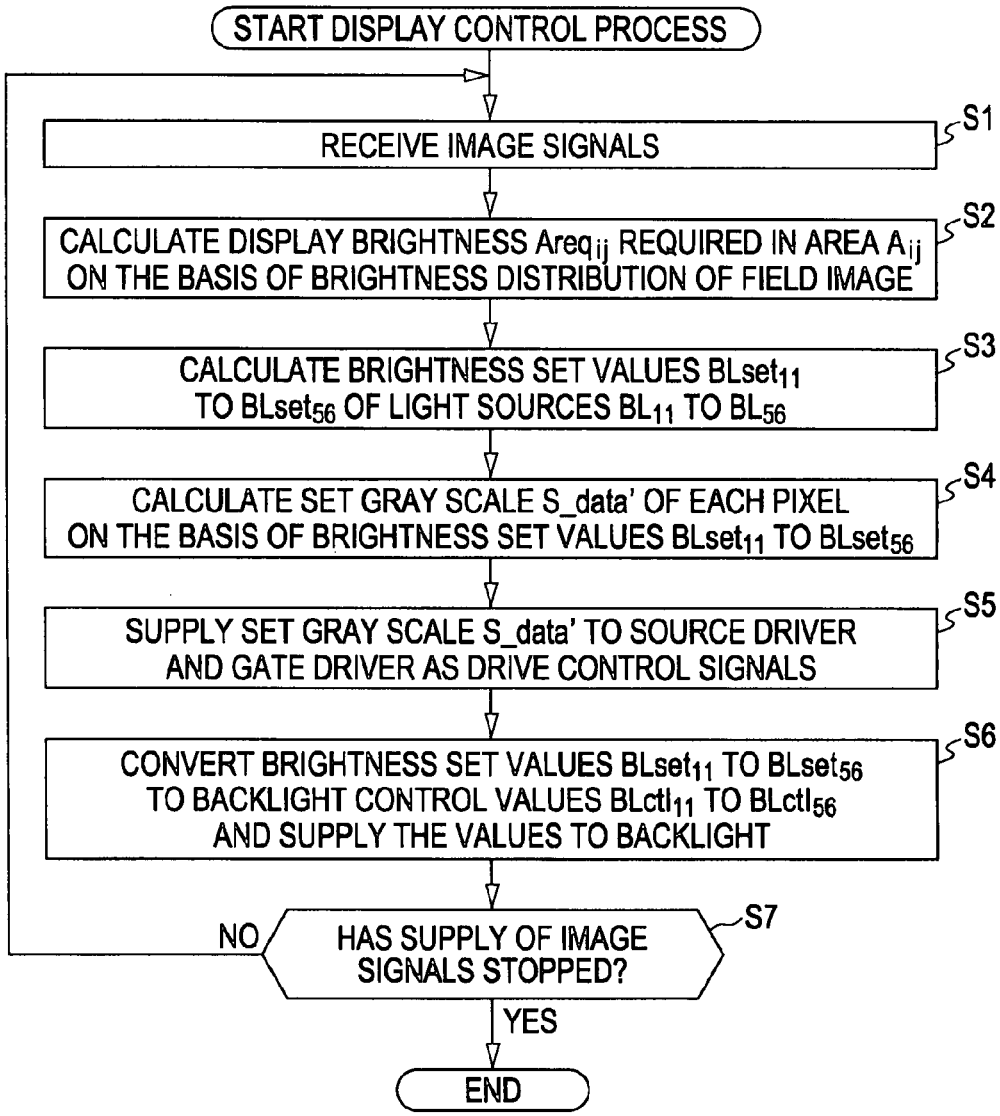
FIG. 4 is a flowchart illustrating a display control process performed in the LCD device shown in FIG. 3.

Now, a display control process performed in the LCD device 1 shown in FIG. 3 is described with reference to the flowchart shown in FIG. 4.

First, in step S1, the liquid crystal panel control circuit 31 receives image signals supplied from another device. The image signals correspond to one field image.

In step S2, the liquid crystal panel control circuit 31 obtains the brightness distribution of the field image. Also, the liquid crystal panel control circuit 31 calculates the display brightness $Areq_{ij}$ required in the area $A_{ij}$ on the basis of the brightness distribution of the field image.

In step S3, the liquid crystal panel control circuit 31 solves simultaneous equations written for the respective areas $A_{11}$ to $A_{56}$, each of the equations defining that the sum of products of the brightness set values $BLset_{11}$ to $BLset_{56}$ of the light sources $BL_{11}$ to $BL_{56}$ and the contribution ratio of the light sources $BL_{11}$ to $BL_{56}$ to the area $A_{ij}$ is the display brightness $Areq_{ij}$, so as to calculate the brightness set values $BLset_{11}$ to $BLset_{56}$ of the light sources $BL_{11}$ to $BL_{56}$, and supplies the brightness set values $BLset_{11}$ to $BLset_{56}$ to the light source control circuit 33.

In step S4, the liquid crystal panel control circuit 31 calculates the set gray scale S_data' of each pixel in the display unit 21 on the basis of the brightness set values $BLset_{11}$ to $BLset_{56}$ by using the set gray scale conversion table stored in the memory 14.

In step S5, the liquid crystal panel control circuit 31 supplies the calculated set gray scale S_data' as drive control signals to the source driver 22 and the gate driver 23 of the liquid crystal panel 11.

In step S6, the light source control circuit 33 converts the 8-bit brightness set values $BLset_{11}$ to $BLset_{56}$ supplied from the liquid crystal panel control circuit 31 to 10-bit backlight control values $BLctl_{11}$ to $BLctl_{56}$ on the basis of the backlight control value conversion table stored in the memory 32, and supplies the backlight control values $BLctl_{11}$ to $BLctl_{56}$ to the backlight 12.

In step S7, the liquid crystal panel control circuit 31 determines whether supply of image signals has stopped. If the liquid crystal panel control circuit 31 determines in step S7 that image signals are supplied, the process returns to step S1, and steps S1 to S7 are performed. Accordingly, the LCD device 1 displays a next field image.

On the other hand, if the liquid crystal panel control circuit 31 determines in step S7 that supply of image signals has stopped, the process ends.

The above-described method for controlling the backlight 12 so that each of the light sources $BL_{11}$ to $BL_{56}$ emits light with optimal (minimum) emission brightness for the field image is called "partial control of the backlight" in the following description. On the other hand, the conventional method for controlling the backlight 12 so that each of the light sources $BL_{11}$ to $BL_{56}$ emits light with almost maximum and same emission brightness is called "total control of the backlight".

Hereinafter, the conventional total control of the backlight and the partial control of the backlight in the LCD device 1 shown in FIG. 3 are briefly described by using specific numeric values. An actual control is performed on each of R, G, and B, but the description is made by using 0th to 255th levels (8 bits) of gray scale (black and white) for simplicity.

For example, in the conventional total control of the backlight, if the display brightness of a predetermined pixel PIX in the display unit 21 should be 128 on the basis of supplied image signals, the backlight 12 evenly emits light with 100% output, that is, with emission brightness of 255, for all of the pixels in the display unit 21. At this time, the aperture ratio of the pixel PIX is set to 50%. Accordingly, a display brightness of 128 (50% of 255th gray scale level) can be realized.

On the other hand, in the partial control of the backlight according to the LCD device 1 shown in FIG. 3, the brightness set value $BLset_{ij}$ of the light source $BL_{ij}$ in the area $A_{ij}$ including the pixel PIX is set to 128 (50% output of the light source $BL_{ij}$), and the aperture ratio of the pixel PIX is set to 100%, so that a display brightness of 128 can be realized.

In this method, there is no need to allow the light source $BL_{ij}$ to emit light with the maximum emission brightness 255, and thus the power consumption can be reduced. This example is based on the assumption that the maximum display brightness of the pixels in the area $A_{ij}$ is 128, the display brightness of the pixel PIX.

In the partial control of the backlight, if the aperture ratio of the pixel PIX is set to 50%, as in the total control of the backlight, the display brightness of the pixel PIX is 64, which is a half of 128. In the partial control of the backlight, if the liquid crystal panel control circuit 31 changes the aperture ratio of the pixel PIX from 50% to 100%, the remaining display brightness of 64 can be apparently obtained. In this specification, the brightness increased by changing the aperture ratio from that set at the total control of the backlight, that is, the brightness apparently obtained by controlling the aperture ratio, is called "liquid crystal corrected brightness".

The conventional total control and the partial control of the backlight are further described with reference to FIG. 5.

Figure 5:
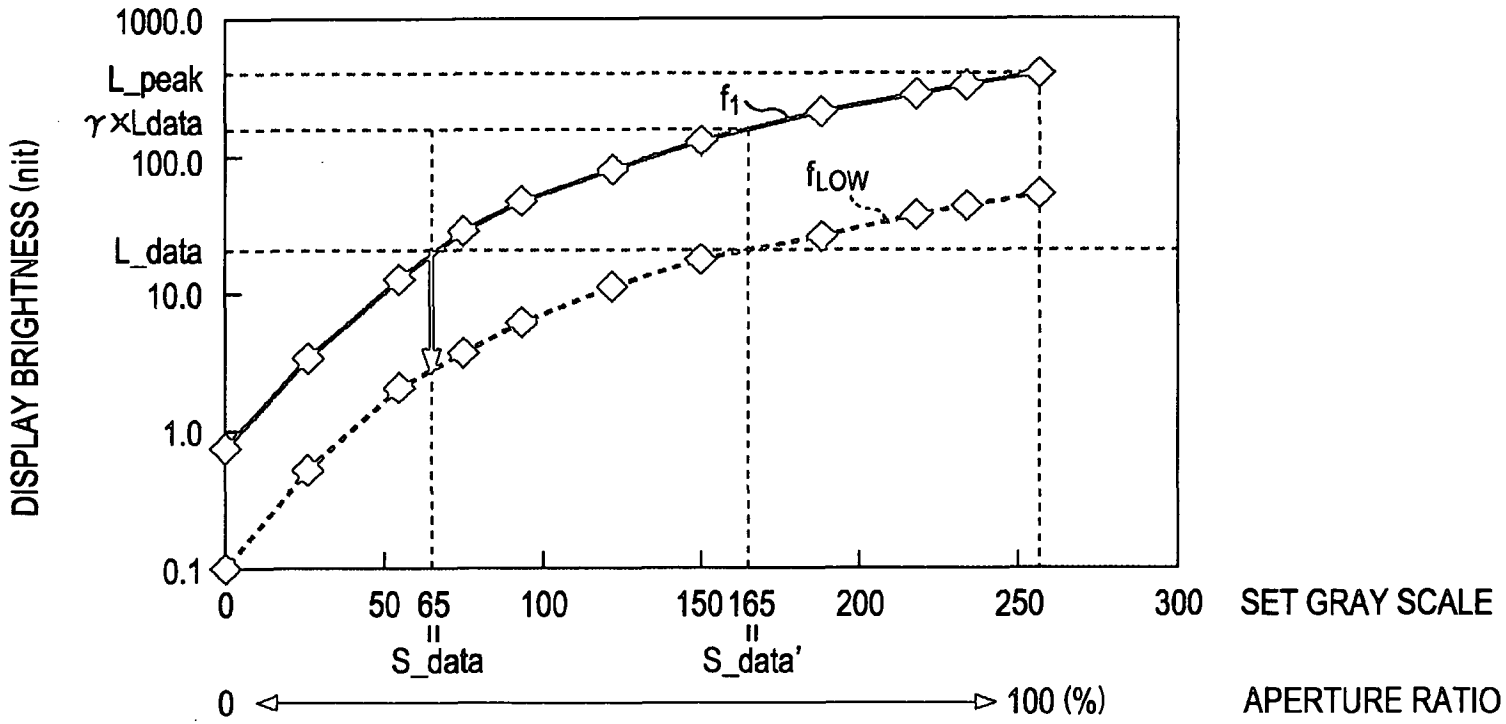
FIG. 5 illustrates total control and partial control of a backlight.

FIG. 5 shows a display brightness characteristic indicating the relationship between the set gray scale corresponding to the aperture ratio and the display brightness (nit=cd/$m^2$).

In FIG. 5, 256 levels of gray scale can be set. For example, a set gray scale of 0 corresponds to an aperture ratio of 0%, whereas a set gray scale of 255 corresponds to an aperture ratio of 100%.

In FIG. 5, a display brightness characteristic $f_1$ indicated by a solid curve represents a display brightness characteristic in the total control of the backlight. That is, the display brightness characteristic $f_1$ represents the display brightness obtained when the gray scale is set to 0 to 255 in a state where the light source $BL_{ij}$ emits light with 100% output.

On the other hand, a display brightness characteristic fLow indicated by a dotted curve represents a display brightness characteristic in the partial control of the backlight. That is, the display brightness characteristic $f_{LOW}$ represents the display brightness obtained when the gray scale is set to 0 to 255 in a state where the light source $BL_{ij}$ emits light based on the brightness set value $BLset_{ij}$, in which output of the light source $BL_{ij}$ is suppressed by $\epsilon$ %.

As described above, in the LCD device 1 shown in FIG. 3, the brightness set values $BLset_{11}$ to $BLset_{56}$ of the light sources $BL_{11}$ to $BL_{56}$ can be obtained on the basis of the display brightness $Areq_{ij}$ required in the area $A_{ij}$.

Now, assume that the display brightness of the pixel PIX is set to L_data. In this case, in the total control of the backlight in which the light source $BL_{ij}$ emits light with 100% output, it can be understood that the gray scale is set to 65 (=S_data) in accordance with the display brightness characteristic $f_1$.

On the other hand, in the partial control of the backlight, the light source $BL_{ij}$ emits light with the brightness set value $BLset_{ij}$ in which the output is suppressed by ϵ %. Thus, in order to obtain the display brightness L_data in the pixel PIX, the gray scale needs to be set to 165 (=S_data') as shown in FIG. 5.

Actually, in the LCD device 1, only the set gray scale conversion table corresponding to the display brightness characteristic $f_1$ is stored in the memory 14.The liquid crystal panel control circuit 31 calculates the set gray scale S_data' in the following manner by using the set gray scale conversion table corresponding to the display brightness characteristic $f_1$.

First, the liquid crystal panel control circuit 31 calculates an output ratio of the light source $BL_{ij}$. More specifically, the liquid crystal panel control circuit 31 calculates the ratio $\gamma_{ij}$ between the display brightness L_peak obtained when the light source $BL_{ij}$ emits light with 100% output and the display brightness $L_set_{ij}$ obtained when the light source $BL_{ij}$ emits light based on the brightness set value $BLset_{ij}$ in which the output is suppressed by ϵ% by using expression (1). Note that the aperture ratio is 100% in both cases.

$$\gamma_{ij}=L_peak/L_set_{ij} \quad (1)$$

Then, the liquid crystal panel control circuit 31 calculates the set gray scale S_data' of the pixel PIX on the basis of the ratio $\gamma_{ij}$ between the display brightness L_peak and the display brightness $L_set_{ij}$ and the display brightness L_data by using expression (2).

$$S_data'=f^{-1}(\gamma_{ij}\times L_data) \quad (2)$$

Expression (2) expresses that, in order to obtain the display brightness L_data by the light source $BL_{ij}$ emitting light with output suppressed by ϵ % in the partial control of the backlight, the set gray scale S_data' (=165) is required, which is the same as the set gray scale when the light source $BL_{ij}$ emits light with 100% output so as to obtain the display brightness ($\gamma_{ij}\times$L_data).

Next, the backlight control value conversion table stored in the memory 32 is described with reference to FIGS. 6 and 7.

As described above, the backlight control value conversion table is used to convert an 8-bit brightness set value $BLest_{ij}$ supplied from the liquid crystal panel control circuit 31 to a 10-bit backlight control value $BLctl_{ij}$ that is a control signal acceptable by the backlight 12.

Figure 6:
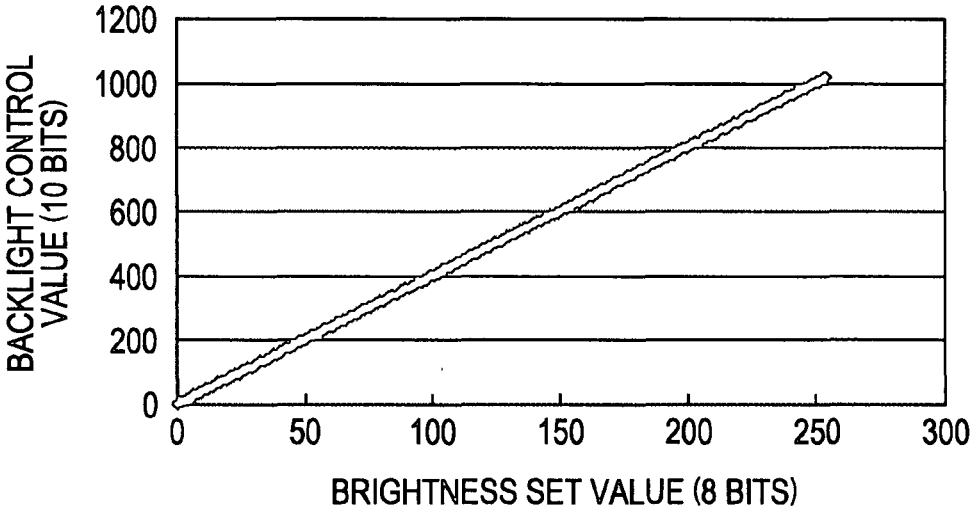
FIG. 6 illustrates a backlight control value conversion table.

The backlight control value conversion table linearly converts the brightness set value $BLset_{ij}$ supplied from the liquid crystal panel control circuit 31 to the backlight control value $BLctl_{ij}$, as shown in FIG. 6.

In other words, according to the backlight control value conversion table, four times the brightness set value $BLset_{ij}$ supplied from the liquid crystal panel control circuit 31 is the backlight control value $BLctl_{ij}$.

Figure 7:
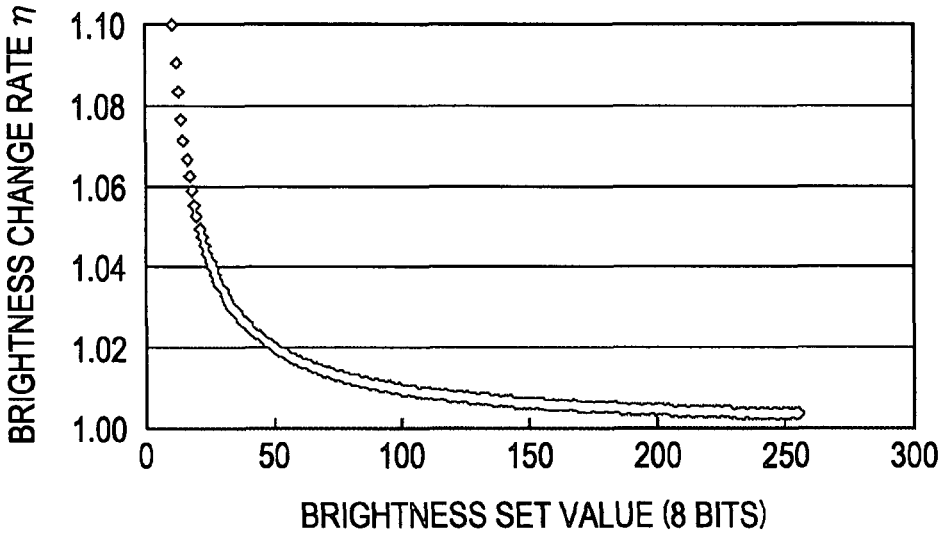
FIG. 7 shows a change rate η of emission brightness in the LCD device shown in FIG. 3.

FIG. 7 shows the change rate η of emission brightness in a case where the brightness set value $BLset_{ij}$ is converted to the backlight control value $BLctl_{ij}$ in accordance with the backlight control value conversion table shown in FIG. 6.

The change rate η of emission brightness indicates the rate of change in the backlight control value $BLctl_{ij}$ caused by an increase in the brightness set value $BLset_{ij}$ by 1. The change rate $\eta_n$ of emission brightness when the brightness set value $BLset_{ij}$ changes from $BLset_{n-1}$ to $BLset_n$ ($1\leq n\leq 255$) can be expressed by the following expression (3).

$$\eta_n=BLctl_n/BLctl_{n-1} \quad (3)$$

In expression (3), the backlight control value $BLctl_n$ is the backlight control value $BLctl_{ij}$ corresponding to the brightness set value $BLset_n$ obtained by the backlight control value conversion table shown in FIG. 6. Likewise, the backlight control value $BLctl_{n-1}$ is the backlight control value $BLctl_{ij}$ corresponding to the brightness set value $BLset_{n-1}$.

As shown in FIG. 7, the change rate η of emission brightness is higher as the brightness set value $BLset_{ij}$ is smaller, and becomes lower as the brightness set value $BLset_{ij}$ is larger.

As described above, in the LCD device 1, the display brightness depends on the emission brightness of the light sources $BL_{11}$ to $BL_{56}$ included in the backlight 12 and the aperture ratio of each pixel corresponding to a set gray scale. The process of determining the emission brightness of the light sources $BL_{11}$ to $BL_{56}$ included in the backlight 12 and the aperture ratio of each pixel is repeatedly performed in units of field images, as described above with reference to FIG. 4.

Therefore, in a predetermined pixel or a predetermined area including a plurality of pixels in an original image, even if the brightness of the original image itself is the same among a plurality of field images, the display brightness in the predetermined area in the respective field images is often realized by a different combination of the emission brightness of the light sources $BL_{11}$ to $BL_{56}$ and the aperture ratio of each pixel, due to an effect of the brightness around the predetermined area.

Figure 8A:
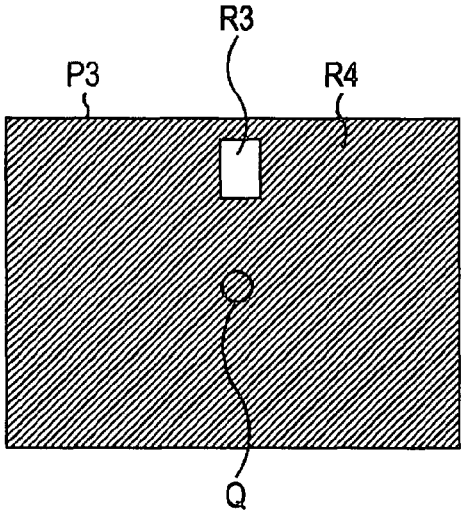
FIGS. 8A to 8D illustrate a process of determining the emission brightness of light sources $BL_{11}$ to $BL_{56}$ and the aperture ratio of each pixel.
Figure 8B:
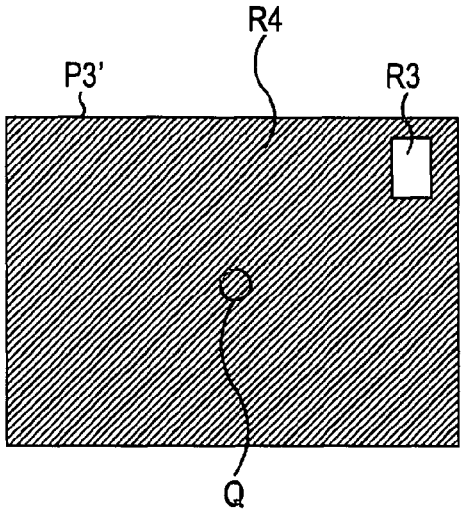

Both an original image P3 shown in FIG. 8A and an original image P3' shown in FIG. 8B include a light portion R3 of high brightness and a dark portion R4 of low brightness. The original images P3 and P3' differ from each other only in the position of the light portion R3. In the original image P3, the light portion R3 is placed on the upper side in the center. On the other hand, in the original image P3', the light portion R3 is placed at upper right.

Herein, attention is focused on a predetermined area Q in the dark portion R4 in the original images P3 and P3'.

Figure 8C:
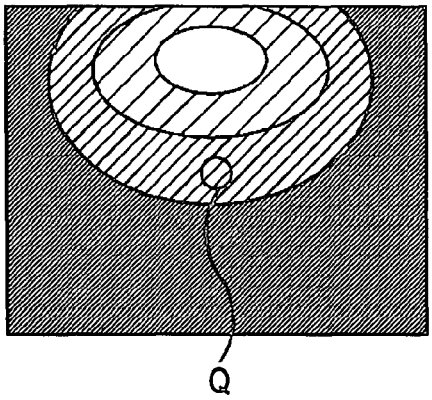
Figure 8D:
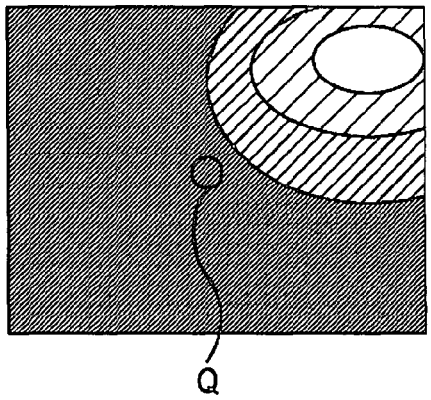

FIG. 8C shows distribution of the emission brightness of the backlight 12 for displaying the original image P3 (FIG. 8A). On the other hand, FIG. 8D shows distribution of the emission brightness of the backlight 12 for displaying the original image P3' (FIG. 8B).

In the original image P3, the light portion R3 is near the predetermined area Q. Thus, the emission brightness in the predetermined area Q is high and the predetermined area Q is affected by the high emission brightness to display the light portion R3, as shown in FIG. 8C.

On the other hand, in the original image P3', the light portion R3 is away from the predetermined area Q. Thus, the predetermined area Q is not affected by the high emission brightness to display the light portion R3, as shown in FIG. 8D.

Assume that the display brightness Panel_V in the predetermined area Q in the original image P3 depends on the emission brightness BL_V1 of the backlight 12 and the aperture ratio LC_V1 of each pixel and that the display brightness Panel_V in the predetermined area Q in the original image P3' depends on the emission brightness BL_V2 of the backlight 12 and the aperture ratio LC_V2 of each pixel. In this case, the following relationship is established between the emission brightness BL_V1 and BL_V2 and between the aperture ratios LC_V1 and LC_V2. That is, the emission brightness BL_V1 is higher than the emission brightness BL_V2 (BL_V1>BL_V2) and the aperture ratio LC_V1 is lower than the aperture ratio LC_V2 (LC_V1 <LC_V2).

Figure 9:
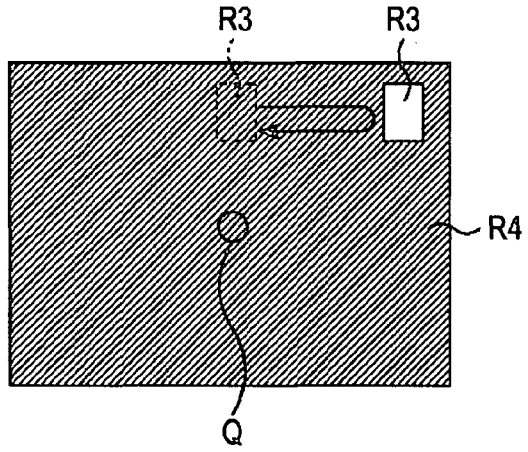
FIG. 9 illustrates a moving image displayed in the LCD device.

For example, in the moving image shown in FIG. 9, the light portion R3 moves from a start position, which is the same position as in the original image P3 shown in FIG. 8A (upper side in the center), to the same position as in the original image P3' shown in FIG. 8B (upper right), and then returns to the start position during ten field time periods from the zeroth field time to the tenth field time (one field time period is 1/60 seconds=about 16.7 milliseconds). In this example, the relationship between the emission brightness BL_V and the aperture ratio LC_V of each pixel in the predetermined area Q is shown in FIG. 10.

Figure 10:
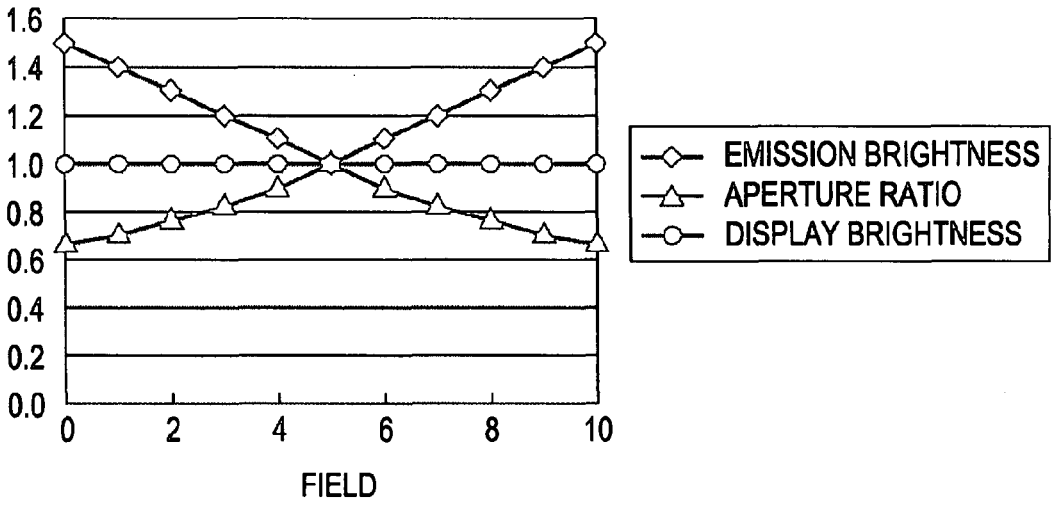
FIG. 10 shows an ideal relationship between emission brightness BL_V and aperture ratio LC_V of a pixel.

In FIG. 10, the emission brightness BL_V, the aperture ratio of the pixel LC_V, and the display brightness Panel_V of the filed images from the zeroth field time to the tenth field time are shown in relative values, in which the emission brightness BL_V, the aperture ratio of the pixel LC_V, and the display brightness Panel_V of the filed image at the fifth field time are reference.

In FIG. 10, the emission brightness BL_V of the backlight 12 indicated by a solid line with rhombuses is the highest when the light portion R3 is at the position same as in the original image P3 shown in FIG. 8A (upper side in the center), that is, at the zeroth field time and the tenth field time, and is the lowest when the light position R3 is at the position same as in the original image P3' shown in FIG. 8B (upper right), that is, at the fifth field time.

On the other hand, the aperture ratio LC_V indicated by a solid line with triangles is the lowest when the light portion R3 is at the position same as in the original image P3 shown in FIG. 8A (upper side in the center), that is, at the zeroth field time and the tenth field time, and is the highest when the light position R3 is at the position same as in the original image P3' shown in FIG. 8B (upper right), that is, at the fifth field time.

The display brightness Panel_V in the predetermined area Q indicated by a solid line with circles is of course constant during the ten field time periods.

According to the above description, the display brightness depends on the emission brightness of the backlight 12 and the aperture ratio of the pixels. Even when the emission brightness of the backlight 12 changes, the same display brightness can be maintained by changing the aperture ratio of the pixels accordingly, as shown in FIG. 10. However, the relationship between the emission brightness BL_V of the backlight 12 and the aperture ratio LC_V of the pixels shown in FIG. 10 is an ideal state, which is not always be realized in actual control.

There are two reasons. One of them is delay of response of liquid crystal control, and the other is a setting error in the set gray scale conversion table stored in the memory 14.

The first reason, delay of response of liquid crystal control, is described.

The aperture ratio LC_V of each pixel, that is, the set gray scale S_data' of each pixel in the display unit 21, is calculated and drive control signals corresponding to the set gray scale S_data' are supplied to the liquid crystal panel 11 every field time period. In the liquid crystal panel 11, the ideal state shown in FIG. 10 can be realized if an operation of changing the aperture ratio completes with 100% completion within one filed time period. However, according to experimental data, an actual operation of changing the aperture ratio may achieve about 70% completion within one field time period.

Figure 11:
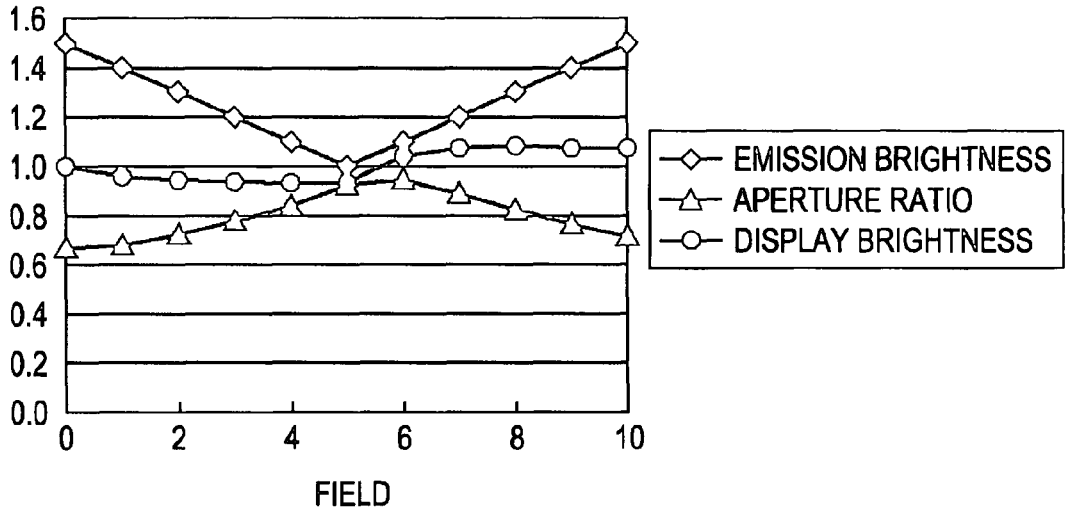
FIG. 11 shows the relationship between emission brightness BL_V and aperture ratio LC_V of a pixel when delay of response of liquid crystal control occurs.

FIG. 11 shows the relationship between the emission brightness BL_V and the aperture ratio LC_V of the pixels in the predetermined area Q in a case where the operation of changing the aperture ratio is performed with about 70% completion within one filed time period.

In FIG. 11, the emission brightness BL_V of the backlight 12 indicated by a solid line with rhombuses is the same as in FIG. 10.

On the other hand, the aperture ratio LC_V of the pixels indicated by a solid line with triangles is lower than the ideal value shown in FIG. 10 from the zeroth field time to the fifth field time when the emission brightness BL_V decreases, due to delay of response of liquid crystal control. As a result, the display brightness Panel_V in the predetermined area Q indicated by a solid line with circles is also lower than the ideal value shown in FIG. 10. The aperture ratio LC_V of the pixels is higher than the ideal value shown in FIG. 10 from the sixth field time to the tenth field time when the emission brightness BL_V increases. As a result, the display brightness Panel_V in the predetermined area Q indicated by the solid line with circles is also higher than the ideal value shown in FIG. 10.

Figure 12:
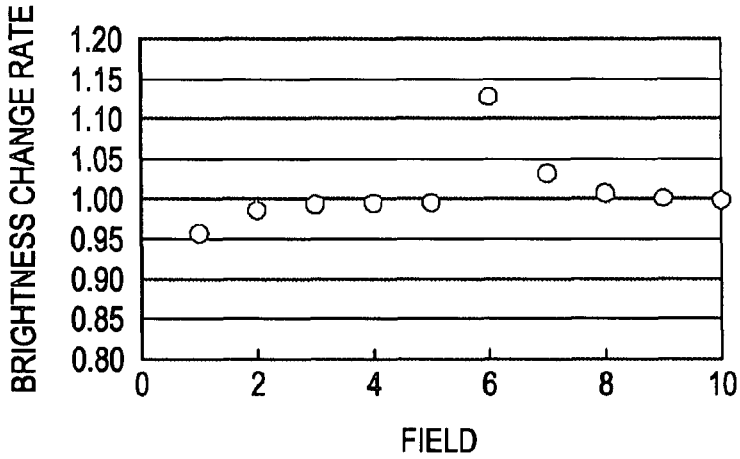
FIG. 12 shows a change rate of display brightness at each field time shown in FIG. 11.

FIG. 12 shows the change rate of the display brightness in the predetermined area Q at each field time shown in FIG. 11.

The change rate of the display brightness indicates the change rate of the display brightness between the current field time and the previous field time. As shown in FIG. 12, the change rate is the highest at the sixth field time, when the tendency of the emission brightness BL_V of the backlight 12 changes, that is, when the emission brightness BL_V of the backlight 12 starts to increase.

An experiment or experience shows that, if the change rate of display brightness is 5% or more, the change is recognized by a human as flicker of images, although an environment and a difference among individuals are considered. The change rate of display brightness at the sixth field time shown in FIG. 12 is about 12% (1.12), and thus this state is recognized by a human as flicker of images due to delay of response of liquid crystal control.

Next, the other reason, a setting error in the set gray scale conversion table, is described.

As described above, the liquid crystal panel control circuit 31 calculates the set gray scale S_data' of each pixel on the basis of the brightness set values $BLset_{11}$ to $BLset_{56}$ by using the set gray scale conversion table corresponding to the display brightness characteristic $f_1$ shown in FIG. 5. The setting error in the set gray scale conversion table is deviation from the true value of the display brightness characteristic $f_1$ in the set gray scale conversion table stored in the memory 14.

Figure 13:
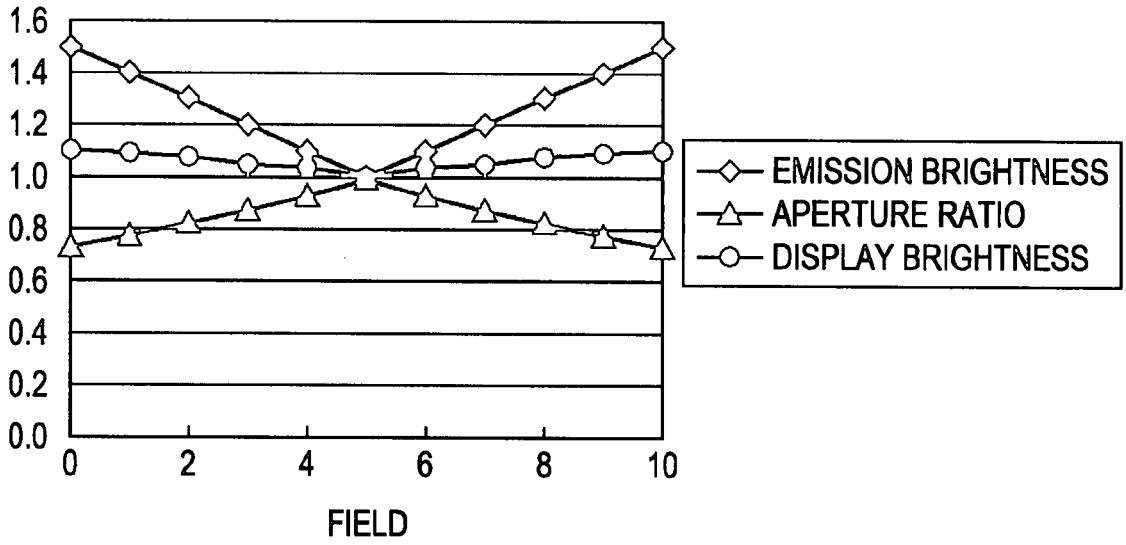
FIG. 13 shows the relationship between emission brightness BL_V and aperture ratio LC_V of a pixel when a setting error occurs in a set gray scale conversion table.
Figure 14:
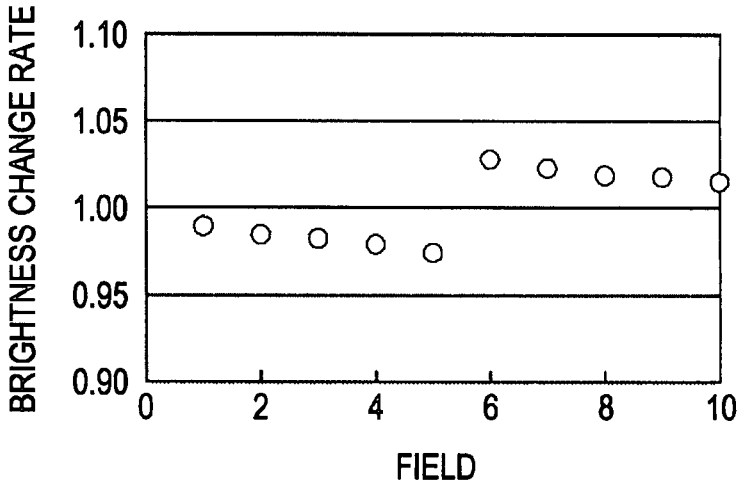
FIG. 14 shows a change rate of display brightness at each field time shown in FIG. 13.

FIG. 13 shows the relationship between the emission brightness BL_V and the aperture ratio LC_V of the pixels in the predetermined area Q in a case where 3% of setting error in the set gray scale conversion table exists per 10% of change in brightness of the backlight 12. FIG. 14 shows the change rate of the display brightness at each field time shown in FIG. 13.

As shown in FIG. 14, even when the setting error in the set gray scale conversion table exists, the change rate of the display brightness is the highest at the sixth field time, when the tendency of the emission brightness BL_V of the backlight 12 changes, that is, when the emission brightness BL_V starts to increase. The change rate of the display brightness at the sixth field time is about 2.5% (1.025).

Figure 15:
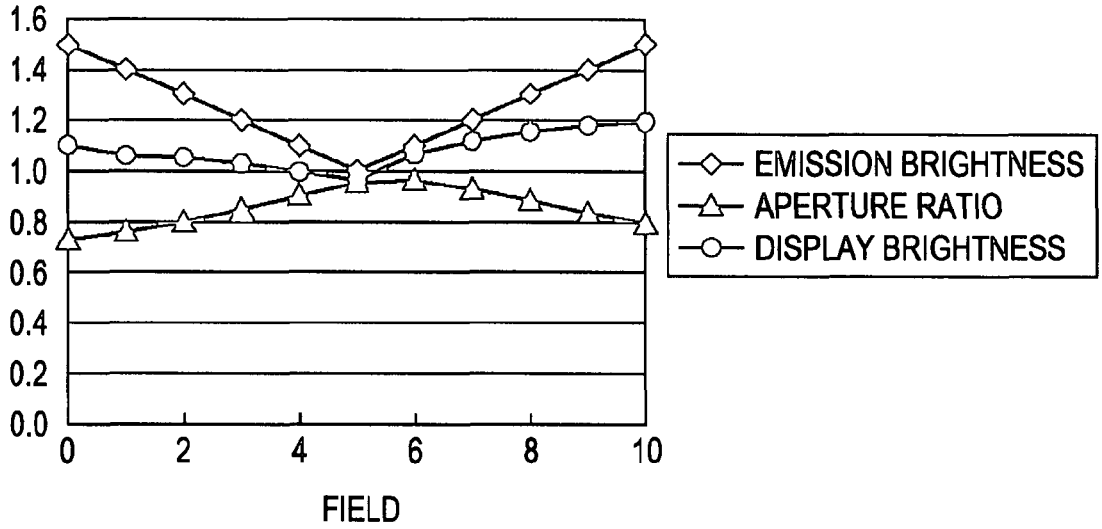
FIG. 15 shows the relationship between emission brightness BL_V and aperture ratio LC_V of a pixel when both delay of response of liquid crystal control and a setting error in the set gray scale conversion table occur.
Figure 16:
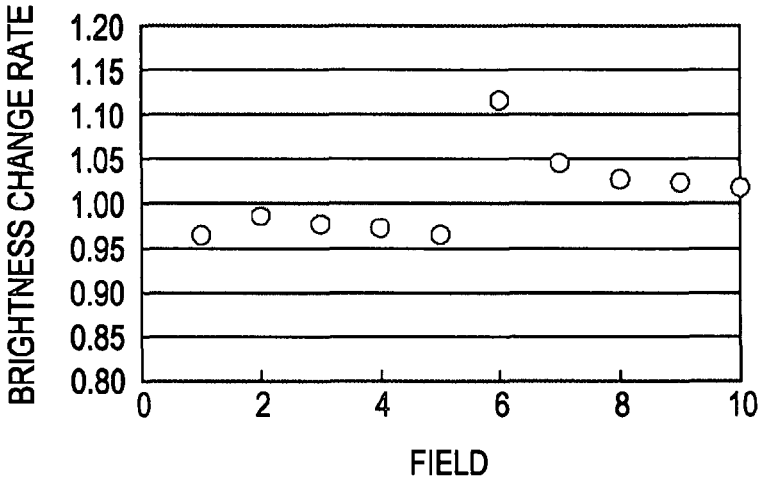
FIG. 16 shows a change rate of display brightness at each field time shown in FIG. 15.

FIG. 15 shows the relationship between the emission brightness BL_V and the aperture ratio LC_V of the pixels in the predetermined area Q in a case where both delay of response of liquid crystal control and the setting error in the set gray scale conversion table exist. FIG. 16 shows the change rate of the display brightness at each field time shown in FIG. 15.

In FIG. 15, since both delay of response of liquid crystal control and the setting error exist, an error in the display brightness Panel_V in the predetermined area Q, that is, the difference from the ideal state shown in FIG. 10, is more significant. Also, the change rate of the display brightness shown in FIG. 16 is higher than that shown in FIGS. 12 and 14. The change rate is the highest of 11.4% at the sixth field time.

As described above, in the predetermined area Q, the delay of response of liquid crystal control and the setting error in the set gray scale conversion table inhibit the ideal relationship between the emission brightness BL_V and the aperture ratio LC_V of the pixels shown in FIG. 10. As a result, the change rate of the display brightness is 5% or more, so that flicker of images occurs.

In another embodiment of the present invention described below, flicker of images is reduced by suppressing the change rate of display brightness to 5% or less based on the assumption that the above-described delay of response of liquid crystal control and the setting error in the set gray scale conversion table are inevitable.

Figure 17:
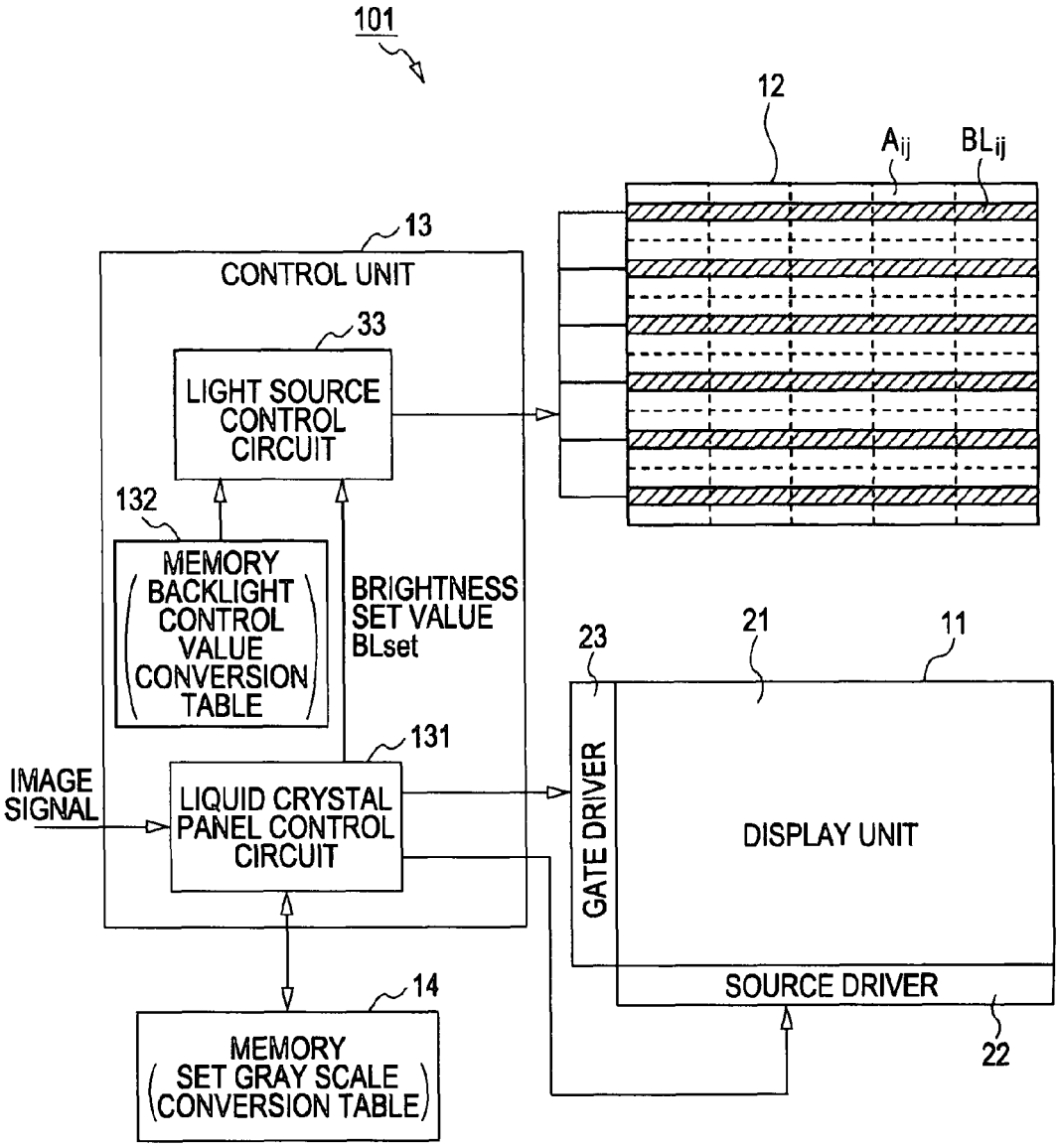
FIG. 17 shows an example of a configuration of an LCD device according to an embodiment of the present invention.

FIG. 17 shows an example of a configuration of an LCD device 101 in which the change rate of the display brightness is suppressed to 5% or less so as to reduce flicker of images.

That is, the LCD device 101 shown in FIG. 17 is an LCD device according to an embodiment of the present invention. In FIG. 17, the parts corresponding to those in FIG. 3 are denoted by the same reference numerals and the description there of is omitted.

The LCD device 101 includes the liquid crystal panel 11, the backlight 12, the control unit 13 and the memory 14, as in the LCD device 1 shown in FIG. 3.

The control unit 13 includes a liquid crystal panel control circuit 131, the light source control circuit 33, and a memory 132. The control unit 13 is different from that in the LCD device 1 shown in FIG. 3 in that the liquid crystal panel control circuit 131 is provided instead of the liquid crystal panel control circuit 31 and that the memory 132 storing a backlight control value conversion table different from that shown in FIG. 6 is provided.

As the liquid crystal panel control circuit 31, the liquid crystal panel control circuit 131 solves simultaneous equations written for the respective areas $A_{11}$ to $A_{56}$, each of the equations defining that the sum of products of the brightness set values $BLset_{11}$ to $BLset_{56}$ of the light sources $BL_{11}$ to $BL_{56}$ and the contribution ratio of the light sources $BL_{11}$ to $BL_{56}$ to the area $A_{ij}$ is the display brightness $Areq_{ij}$, so as to calculate the brightness set values $BLset_{11}$ to $BLset_{56}$ of the light sources $BL_{11}$ to $BL_{56}$.

Then, the liquid crystal panel control circuit 131 compares the calculated brightness set value $BLset_{ij}$ with the brightness set value $*BLset_{ij}'$ supplied to the light source control circuit 33 at the previous field time, so as to determine the brightness set value $BLset_{ij}'$ of the current filed time.

More specifically, if the calculated brightness set value $BLset_{ij}$ is larger than the brightness set value $*BLset_{ij}'$ of the previous field time ($BLset_{ij}>*BLset_{ij}'$), the liquid crystal panel control circuit 131 sets the brightness set value $*BLset_{ij}'$ of the previous field time added with 1 as the brightness set value $BLset_{ij}'$ of the current field time ($BLset_{ij}'=*BLset_{ij}'+1$).

On the other hand, if the calculated brightness set value $BLset_{ij}$ is smaller than the brightness set value $*BLset_{ij}'$ of the previous field time ($BLset_{ij}<*BLset_{ij}'$), the liquid crystal panel control circuit 131 sets the brightness set value $*BLset_{ij}'$ of the previous field time from which 1 is subtracted as the brightness set value $BLset_{ij}'$ of the current field time ($BLset_{ij}'=*BLset_{ij}'-1$)

That is, the liquid crystal panel control circuit 131 determines the brightness set value $BLset_{ij}''$ of the current field time to be supplied to the light source control circuit 33 so that the brightness set value $BLset_{ij}'$ of the current field time is within one level of gray scale relative to the brightness set value $*BLset_{ij}'$ of the previous field time. If the calculated brightness set value $BLset_{ij}$ is equal to the brightness set value $*BLset_{ij}'$ of the previous field time, the calculated brightness set value $BLset_{ij}$ is set as the brightness set value $BLset_{ij}'$ of the current field time($=*BLset_{ij}'$).

The determined brightness set value $BLset_{ij}'$ of the current field time is supplied to the light source control circuit 33 and is also supplied to the memory 14. In the memory 14, the brightness set value $*BLset_{ij}'$ of the previous field time is overwritten with the brightness set value $BLset_{ij}'$, which is stored therein.

Also, the liquid crystal panel control circuit 131 sets a minimum value of the brightness set value $BLset_{ij}$ to be supplied to the light source control circuit 33. In this embodiment, as described below with reference to FIG. 19, the minimum value is 10 so that the change rate $\eta$ of emission brightness does not exceed about 4%. If the determined brightness set value $BLset_{ij}'$ of the current field time is smaller than 10, the liquid crystal panel control circuit 131 supplies the minimum value 10, not the calculated brightness set value $BLset_{ij}'$, as the brightness set value $BLset_{ij}'$ to the light source control circuit 33.

In the light source control circuit 33 in the LCD device 1 shown in FIG. 3, the 8-bit brightness set value $BLset_{ij}$ supplied from the liquid crystal panel control circuit 31 is linearly converted to the 10-bit backlight control value $BLctl_{ij}$ by using the backlight control value conversion table shown in FIG. 6. As a result, the brightness change rate $\eta_n$ is high when the brightness set value $BLset_{ij}$ supplied from the liquid crystal panel control circuit 31 is small, that is, when the emission brightness BL_V of the backlight 12 is low (dark), as described above with reference to FIG. 7.

Figure 18:
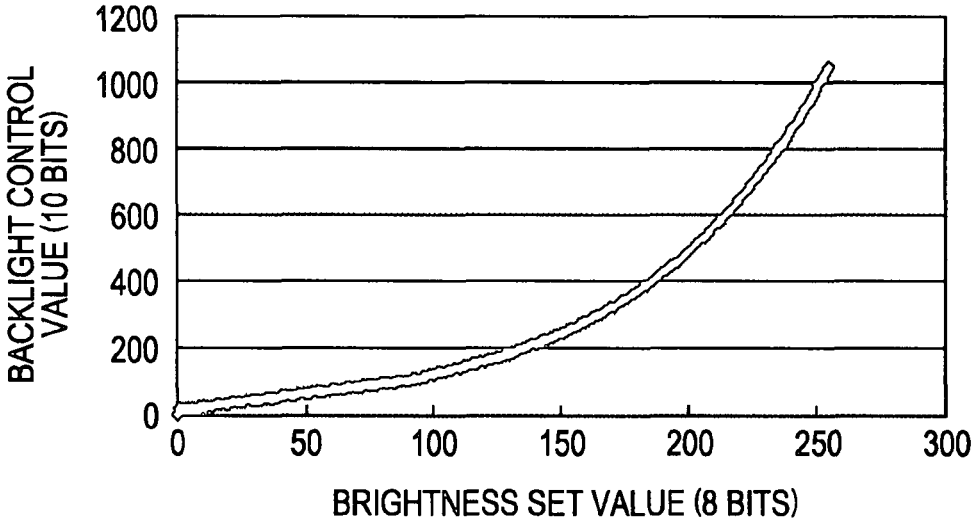
FIG. 18 illustrates a backlight control value nonlinear conversion table.

The light source control circuit 33 in the LCD device 101 shown in FIG. 17 converts the 8-bit brightness set value $BLset_{ij}'$ supplied from the liquid crystal panel control circuit 131 to the 10-bit backlight control value $BLctl_{ij}$ by using the backlight control value conversion table shown in FIG. 18, which is different from the backlight control value conversion table shown in FIG. 6, and supplies the backlight control value $BLctl_{ij}$ to the backlight 12.

FIG. 18 shows the backlight control value conversion table stored in the memory 132. This backlight control value conversion table is called a "backlight control value nonlinear conversion table" so as to distinguish it from the backlight control value conversion table shown in FIG. 6.

This backlight control value nonlinear conversion table nonlinearly converts the 8-bit brightness set value $BLset_{ij}'$ supplied from the liquid crystal panel control circuit 131 to the 10-bit backlight control value $BLctl_{ij}$.

More specifically, according to the conversion based on the backlight control value nonlinear conversion table shown in FIG. 18, the amount of change in the backlight control value $BLctl_{ij}$ caused by an increase in the brightness set value $BLset_{ij}'$ by 1 is small when the brightness set value $BLset_{ij}'$ is small of 0 to 155. As the brightness set value $BLset_{ij}'$ becomes larger, the amount of change in the backlight control value $BLctl_{ij}$ also becomes large.

The backlight control value nonlinear conversion table shown in FIG. 18 can be determined by the following expression (4).

$$BLctl_n = \begin{cases} 0 & BLset_n = 0 \\ \lambda & 1 \leqq BLset_n < X_a \\ 1 + BLctl_{n-1} & X_a \leqq BLset_n < X_b \\ \mathrm{Round}(r \times BLctl_{n-1}) & X_b \leqq BLset_n < 255 \end{cases} \quad (4)$$

In expression (4), λ and r are predetermined constants, and Round is a function to round off the value in the parentheses. $X_a$ and $X_b$ are integers larger than 1 and smaller than 255.

The backlight control value nonlinear conversion table is not limited to that determined by expression (4). Any table can be used as long as conversion can be performed so that the amount of change in the backlight control value BLctl caused by an increase in the brightness set value $BLset_{ij}'$ by 1 becomes large as the brightness set value $BLset_{ij}$ becomes larger.

Figure 19:
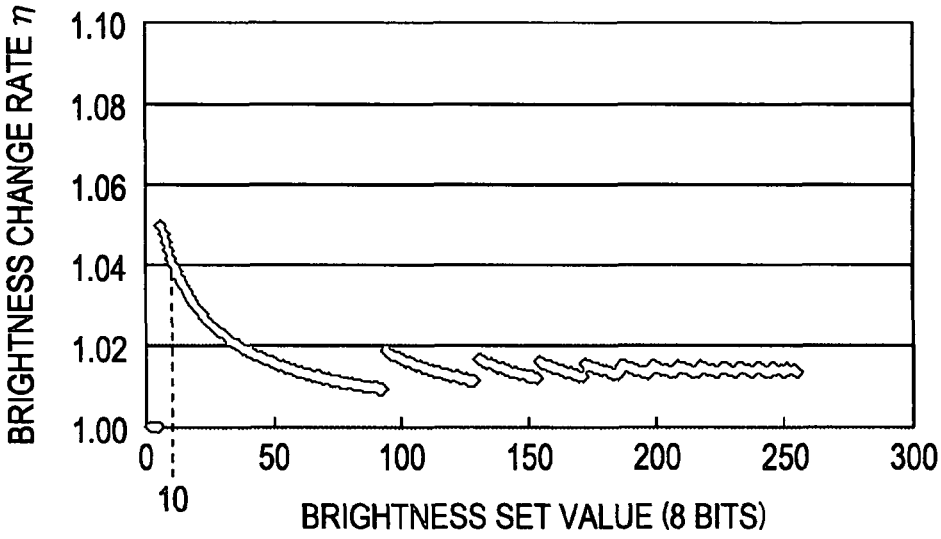
FIG. 19 shows a change rate η of emission brightness in the LCD device shown in FIG. 17.

FIG. 19 shows the change rate η of the emission brightness in the backlight control value nonlinear conversion table shown in FIG. 18.

Even when the brightness set value $BLset_{ij}'$ is converted to the backlight control value $BLctl_{ij}$ by using the backlight control value nonlinear conversion table shown in FIG. 18, suppression of the change rate η of the emission brightness is limited. For this reason, in the liquid crystal panel control circuit 131, the above-described minimum value is provided so that the brightness set value BLset' is not supplied to the light source control circuit 33 if the brightness set value BLset' causes a predetermined change rate η of emission brightness or more. In this embodiment, the minimum value is set to 10 so that the change rate η of the emission brightness does not exceed about 4% (1.04), as described above.

Figure 20:
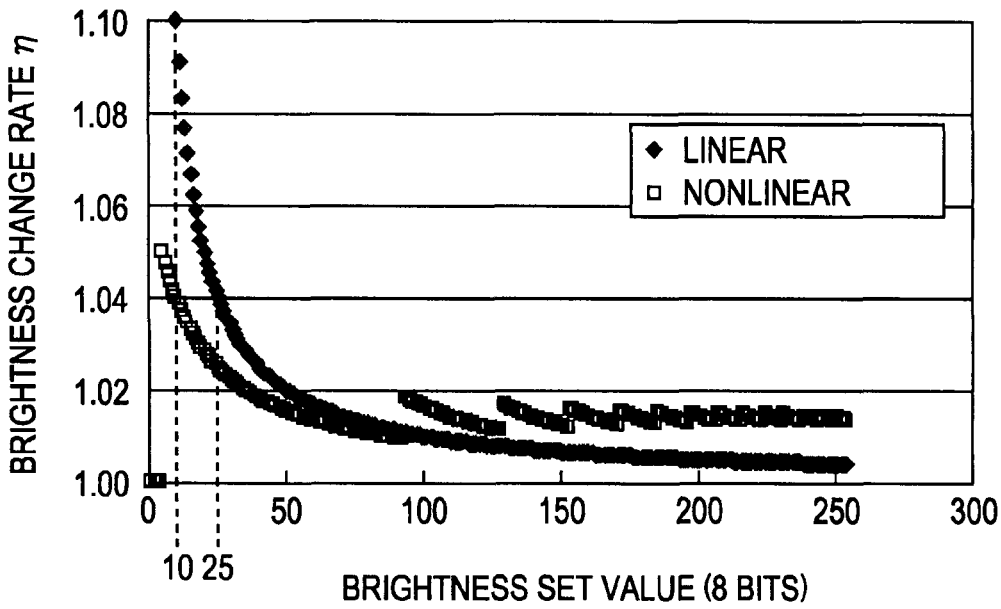
FIG. 20 is for comparing the brightness change rate η shown in FIG. 7 and that shown in FIG. 19.

FIG. 20 is for comparing the brightness change rate η shown in FIG. 7 with the brightness change rate η shown in FIG. 19.

As can be understood from FIG. 20, the change rate η of the emission brightness is suppressed in a narrow range in the brightness set values $BLset_{ij}'$ of 0 to 155 by using the backlight control value nonlinear conversion table shown in FIG. 18.

In other words, the backlight control value nonlinear conversion table shown in FIG. 18 is a table allowing the change rate η of the emission brightness to be a predetermined rate (in FIG. 20, about 5% (1.05)) or less.

The liquid crystal panel control circuit 131 does not supply a brightness set value $BLset_{ij}$ smaller than 10, causing a change rate η of emission brightness of over about 4% (1.04), to the light source control circuit 33. Thus, the backlight control value nonlinear conversion table shown in FIG. 18 is a table allowing the change rate η of the emission brightness to be about 4% (1.04) or less.

In the LCD device 1, if the brightness set value $BLset_{ij}$ causing a change rate η of emission brightness of over about 4% is not supplied to the light source control circuit 33, as in the LCD device 101, the brightness set value $BLset_{ij}$ smaller than 25 is not acceptable, as shown in FIG. 20.

When the brightness set value $BLset_{ij}$ is 25, the backlight control value $BLctl_{ij}$ is 100 (see FIG. 6). When the brightness set value $BLset_{ij}'$ is 10, the backlight control value $BLctl_{ij}$ is 25 (see FIG. 18). Accordingly, when a dark portion of low brightness in an original image is displayed, the emission brightness of the backlight 12 can be set lower in the LCD device 101 using the backlight control value nonlinear conversion table shown in FIG. 18 than in the LCD device 1 using the backlight control value conversion table shown in FIG. 6. Accordingly, low power consumption can be realized and the contrast of the image can be enhanced.

Figure 21:
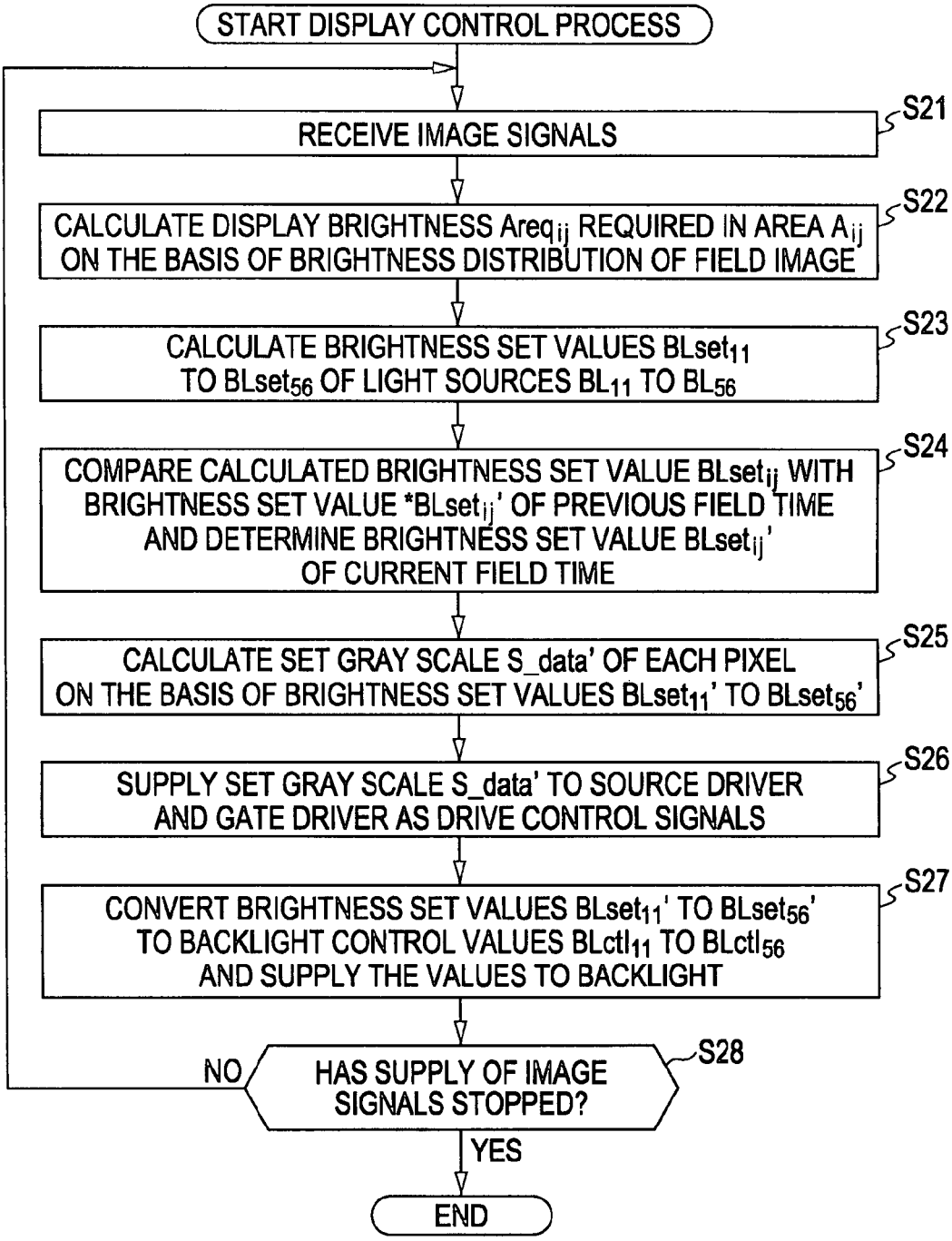
FIG. 21 is a flowchart illustrating a display control process performed in the LCD device shown in FIG. 17.

Now, a display control process performed in the LCD device 101 shown in FIG. 17 is described with reference to the flowchart shown in FIG. 21.

First, in step S21, the liquid crystal panel control circuit 131 receives image signals supplied from another device. The image signals correspond to one field image.

In step S22, the liquid crystal panel control circuit 131 obtains the brightness distribution of the field image. Also, the liquid crystal panel control circuit 131 calculates the display brightness $Areq_{ij}$ required in the area $A_{ij}$ on the basis of the brightness distribution of the field image.

In step S23, the liquid crystal panel control circuit 131 solves simultaneous equations written for the respective areas $A_{11}$ to $A_{56}$, each of the equations defining that the sum of products of the brightness set values $BLset_{11}$ to $BLset_{56}$ of the light sources $BL_{11}$ to $BL_{56}$ and the contribution ratio of the light sources $BL_{11}$ to $BL_{56}$ to the area $A_{ij}$ is the display brightness $Areq_{ij}$, so as to calculate the brightness set values $BLset_{11}$ to $BLset_{56}$ of the light sources $BL_{11}$ to $BL_{56}$.

In step S24, the liquid crystal panel control circuit 131 compares the calculated brightness set value $BLset_{ij}$ with the brightness set value $*BLset_{ij}'$ of the previous field time, so as to determine the brightness set value $BLset_{ij}'$ of the current field time.

That is, if the calculated brightness set value $BLset_{ij}$ is larger than the brightness set value $*BLset_{ij}'$ of the previous field time ($BLset_{ij}>*BLset_{ij}'$), the liquid crystal panel control circuit 131 sets the brightness set value $*BLset_{ij}'$ of the previous field time added with 1 as the brightness set value $BLset_{ij}'$ of the current field time ($BLset_{ij}'=*BLset_{ij}'+1$).

On the other hand, if the calculated brightness set value $BLset_{ij}$ is smaller than the brightness set value $*BLset_{ij}'$ of the previous field time ($BLset_{ij}<*BLset_{ij}'$), the liquid crystal panel control circuit 131 sets the brightness set value $*BLset_{ij}'$ of the previous field time from which 1 is subtracted as the brightness set value $BLset_{ij}'$ of the current field time ($BLset_{ij}'=*BLset_{ij}'-1$).

If the calculated brightness set value $BLset_{ij}$ is equal to the brightness set value $*BLset_{ij}'$ of the previous field time, the liquid crystal panel control circuit 131 sets the calculated brightness set value $BLset_{ij}$ as the brightness set value $BLset_{ij}'$ of the current field time ($=*BLset_{ij}'$).

The determined brightness set value $BLset_{ij}'$ of the current field time is supplied to the light source control circuit 33, and is also supplied to the memory 14 and is stored therein. In the memory 14, the brightness set value $*BLset_{ij}'$ of the previous field time is overwritten with the supplied brightness set value $BLset_{ij}'$, which is stored therein.

If the determined brightness set value $BLset_{ij}'$ of the current field time is smaller than 10, the minimum value 10, not the determined brightness set value $BLset_{ij}'$, is supplied to the light source control circuit 33 as the brightness set value $BLset_{ij}'$. In a process of the first field image, where the brightness set value $*BLset_{ij}'$ of the previous field time has not been stored in the memory 14, the calculated brightness set value $BLset_{ij}$ is supplied to the light source control circuit 33 and the memory 14 as the brightness set value $BLset_{ij}'$.

In step S25, the liquid crystal panel control circuit 131 calculates the set gray scale S_data' of each pixel in the display unit 21 on the basis of the brightness set values $BLset_{11}'$ to $BLset_{56}'$ by using the set gray scale conversion table stored in the memory 14.

In step S26, the liquid crystal panel control circuit 131 supplies the calculated set gray scale S_data' as drive control signals to the source driver 22 and the gate driver 23 of the liquid crystal panel 11.

In step S27, the light source control circuit 33 converts the 8-bit brightness set values $BLset_{11}'$ to $BLset_{56}'$ supplied from the liquid crystal panel control circuit 131 to 10-bit backlight control values $BLctl_{11}$ to $BLctl_{56}$ on the basis of the backlight control value nonlinear conversion table stored in the memory 132, and supplies the backlight control values $BLctl_{11}$ to $BLctl_{56}$ to the backlight 12.

In step S28, the liquid crystal panel control circuit 131 determines whether supply of image signals has stopped. If the liquid crystal panel control circuit 131 determines in step S28 that image signals are supplied, the process returns to step S21, and steps S21 to S28 are performed. Accordingly, the LCD device 101 displays a next field image.

On the other hand, if the liquid crystal panel control circuit 131 determines in step S28 that supply of image signals has stopped, the process ends.

Figure 22:
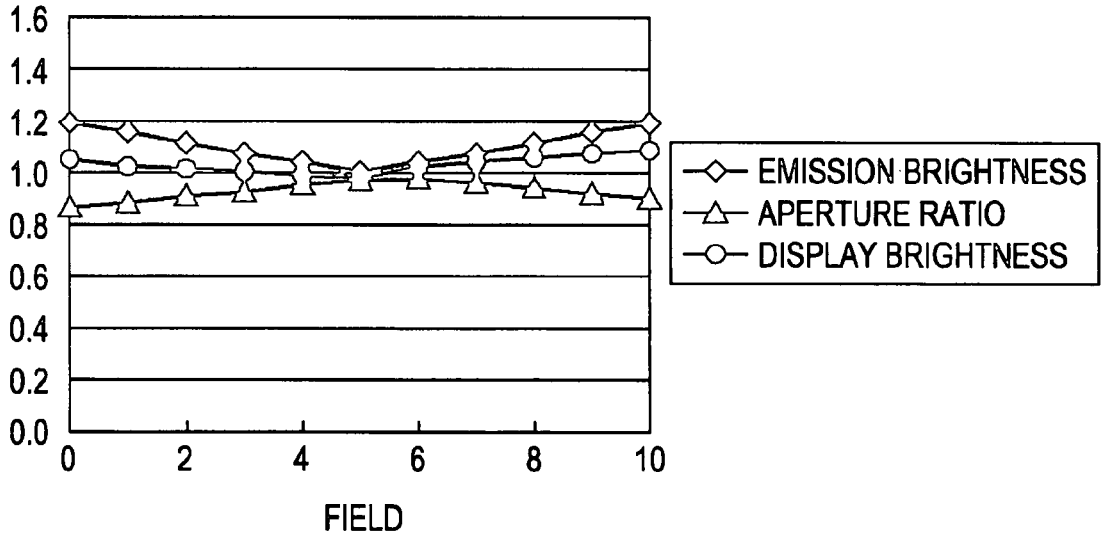
FIG. 22 shows the relationship between emission brightness BL_V and aperture ratio LC_V of a pixel in the LCD device shown in FIG. 17.
Figure 23:
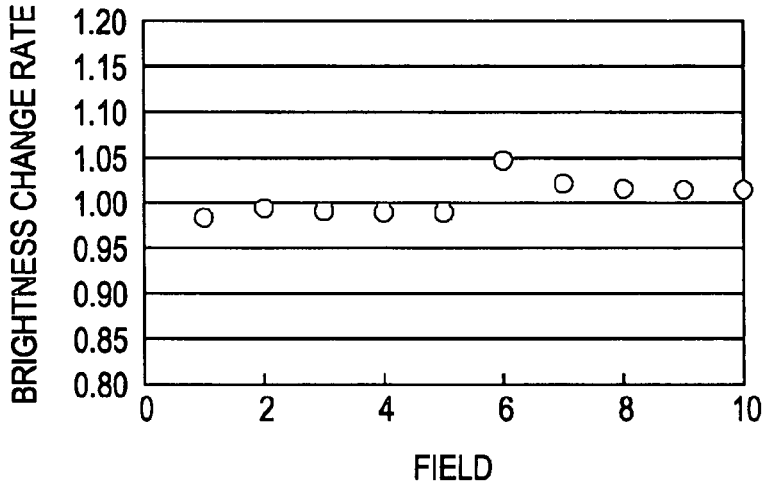
FIG. 23 shows a change rate of display brightness at each field time shown in FIG. 22.

FIGS. 22 and 23 show a result obtained when the LCD device 101 displays the moving image shown in FIG. 9, and correspond to FIGS. 15 and 16.

FIG. 22 corresponds to FIG. 15 and shows the relationship between the emission brightness BL_V and the aperture ratio LC_V of the pixels in the predetermined area Q. FIG. 23 shows the change rate of the display brightness at each field time shown in FIG. 22. The conditions of delay of response of liquid crystal control and a setting error in the set gray scale conversion table are the same as in FIGS. 15 and 16.

In the LCD device 101, the brightness set value $BLset_{ij}'$ is changed in steps of one level of gray scale. Thus, as described above with reference to FIG. 20, the change rate $\eta_n$ of the emission brightness is inevitably 4% (1.04) or less, and thus the change rate of the emission brightness BL_V indicated by a solid line with rhombuses is suppressed, as shown in FIG. 22. As a result, as shown in FIG. 23, the change rate of the display brightness at each field time is suppressed. Even at the sixth field time when the change rate of the display brightness is the maximum, the change rate is 4.5% (1.045).

Therefore, according to the LCD device 101 shown in FIG. 17, the change rate of the display brightness can be suppressed to 5% or less, and thus flicker of images can be reduced.

As described above with reference to FIG. 19, the brightness change rate $\eta$ is the highest of 4% when the brightness set value $BLset_{ij}'$ is the minimum of 10. Thus, the brightness change rate of the emission brightness BL_V indicated by the solid line with rhombuses in FIG. 22 is 4% at the maximum.

On the other hand, in the LCD device 1, the brightness change rate $\eta$ is 10% when the brightness set value BLset is 10, as shown in FIG. 20. Thus, the brightness change rate of the emission brightness BL_V described above with reference to FIG. 15 is 10% at the maximum.

The amount of change in the backlight control value $BLctl_{ij}$ caused by an increase in the brightness set value $BLset_{ij}$ by 1 can be reduced by increasing the number of bits of the brightness set value $BLset_{ij}$ and increasing the number of levels of gray scale. In that case, however, response of emission brightness to the amount of change delays and the efficiency reduces. The above-described example is advantageous in that there is no need to change the number of levels of gray scale of the brightness set value $BLset_{ij}$.

In the above-described embodiment, the LCD device 101 displays images with a frame rate of 60 Hz. However, the frame rate (display rate) of the images displayed by the LCD device 101 is not limited to 60 Hz, but may be lower or higher than 60 Hz.

The areas $A_{11}$ to $A_{56}$ are generated by virtually dividing the lighting area of the backlight 12. Alternatively, the areas $A_{11}$ to $A_{56}$ may be generated by physically dividing the lighting area by providing partitions or the like.

In this specification, the steps described in each flowchart may be performed in time series in accordance with the described order or may be performed in parallel or individually.

The present invention can be applied to an LCD device that includes the backlight 12 capable of controlling lighting in units of areas, the backlight 12 being placed on the back side of the liquid crystal panel 11, and that displays images on the basis of the partial control of the backlight 12 and the control of the aperture ratio of each pixel in the liquid crystal panel 11.

It should be understood by those skilled in the art that various modifications, combinations, sub-combinations and alterations may occur depending on design requirements and other factors insofar as they are within the scope of the appended claims or the equivalents thereof.

What is claimed is:

1. A display device to display an image corresponding to image signals in a predetermined display area, the display device comprising:

a backlight including a plurality of individually-placed backlight sources corresponding to a plurality of areas included in the display area;

a panel that includes a plurality of panel pixels corresponding to the display area and that changes transmittance of light from the plurality of individually-placed backlight sources in units of pixels;

panel control means for calculating emission brightness settings of each of the backlight sources in accordance with the image signals and setting the transmittance of light in each of the panel pixels in accordance with the emission brightness settings of each of the plurality of individually-placed backlight sources set individually;

a nonlinear conversion table stored in storage means; and backlight control means for converting the emission brightness settings of each of the backlight sources calculated by the panel control means to light source control values in accordance with the nonlinear conversion table and supplying the light source control values to the backlight sources.

2. The display device according to claim 1, wherein the nonlinear conversion table is a table in which an amount of change in the light source control value caused by an increase in an emission brightness setting by a predetermined unit becomes large as emission brightness becomes higher.

3. The display device according to claim 1, wherein the nonlinear conversion table is a table in which a rate of change in the light source control value caused by an increase in an emission brightness setting by a predetermined unit is a predetermined rate or lower.

4. The display device according to claim 3, wherein the panel control means further sets a minimum value of the emission brightness setting for each of the backlight sources.

5. A display control method for a display device that includes a backlight including a plurality of individually-placed backlight sources corresponding to a plurality of areas included in a predetermined display area and a panel that includes a plurality of panel pixels corresponding to the display area and that changes transmittance of light from the backlight sources in units of pixels and that displays an image corresponding to image signals in the display area, the display control method comprising the steps of:

calculating emission brightness settings of each of the plurality of individually-placed backlight sources in accordance with the image signals and setting the transmittance of light in each of the panel pixels in accordance with the emission brightness settings of each of the plurality of individually-placed backlight sources; and converting the emission brightness settings of each of the plurality of individually-placed backlight sources to light source control values in accordance with a nonlinear conversion table, wherein the nonlinear conversion table provides a mapping between a brightness setting value from a video image and a brightness control value for controlling the brightness of the backlight sources; and supplying the light source control values to the backlight sources.

6. The display control method according to claim 5, wherein, when each one of the emission brightness settings of the plurality of individually-placed backlight sources is calculated in accordance with the image signals, the each one is set so as to be within one level of gray scale of a corresponding emission brightness setting that is set at a previous time.

7. A display device to display an image corresponding to image signals in a predetermined display area, the display device comprising:

a backlight including a plurality of individually-placed backlight sources corresponding to a plurality of areas included in the display area;

a panel that includes a plurality of panel pixels corresponding to the display area and that changes transmittance of light from the plurality of individually-placed backlight sources in units of pixels;

a panel control unit configured to calculate emission brightness settings of each of the backlight sources in accordance with the image signals and set the transmittance of light in each of the panel pixels in accordance with the emission brightness settings of each of the plurality of individually-placed backlight sources set individually;

a nonlinear conversion table stored in a storage unit, the nonlinear conversion table for converting the emission brightness of each of the plurality of individually-placed backlight sources to light source control values for the backlight; and a backlight control unit configured to convert the emission brightness settings for each of the plurality of individually-placed backlight sources calculated by the panel control unit to the light source control values in accordance with the nonlinear conversion table and supply the light source control values to the backlight sources.

8. The display device according to claim 1, wherein the nonlinear conversion table provides a mapping between a brightness setting value from a video image and a brightness control value that is used to control the brightness of the backlight sources.

9. A display device for displaying an image on a display area comprising:

a backlight comprising a plurality of backlight sources configured to illuminate a plurality of areas within the display area;

a light-modulating panel comprising a plurality of panel pixels each configured to change its transmittance for light incident on the pixel from the backlight responsive to a panel control signal;

a panel controller configured to calculate emission brightness settings for each of the plurality of backlight sources responsive to a received image display signal and to determine values for the panel control signal based upon the calculated emission brightness settings;

a nonlinear conversion table stored in a storage device; and a backlight controller configured to convert the calculated emission brightness settings to light source control values in accordance with the nonlinear conversion table and provide the light source control values to the backlight sources.

10. The display device of claim 9, wherein the nonlinear conversion table provides a mapping of calculated emission brightness settings to light source control values.

11. The display device of claim 10, wherein the nonlinear conversion table is constructed such that a first change in light source control values for a selected amount of change in calculated emission brightness settings at a high brightness setting is greater than a second change in light source control values for the same amount of change in calculated emission brightness settings at a lower brightness setting.

12. The display device of claim 10, wherein the nonlinear conversion table is constructed such that a rate of change in light source control values corresponding to an increase in emission brightness setting by a predetermined unit is a predetermined rate or lower.

13. The display device of claim 10, wherein the nonlinear conversion table includes a minimum light source control value for one or more of the lowest calculated emission brightness settings.

14. The display device of claim 10, further configured to restrict a change in a calculated emission brightness setting from a previous display time for a subsequent display time to a predetermined amount.

15. The display device of claim 14, wherein the predetermined amount is one gray level.

* * * * *